US006922534B2

(12) United States Patent
Goto et al.

(10) Patent No.: US 6,922,534 B2
(45) Date of Patent: Jul. 26, 2005

(54) PROCESS CARTRIDGE AND ELECTROPHOTOGRAPHIC IMAGE FORMING APPARATUS HAVING ELECTRICAL CONNECTION FOR MEMORY

(75) Inventors: Hiroshi Goto, Shizuoka (JP); Seietsu Miura, Kanagawa (JP); Nobuya Tamura, Kanagawa (JP); Yoshihisa Ibaraki, Shizuoka (JP); Yoshiyuki Miyazaki, Shizuoka (JP); Masafumi Maeda, Shizuoka (JP); Masahide Tanoue, Shizuoka (JP); Fumito Nonaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 10/223,636

(22) Filed: Aug. 20, 2002

(65) Prior Publication Data

US 2003/0123896 A1 Jul. 3, 2003

(30) Foreign Application Priority Data

Dec. 28, 2001 (JP) ..... 2000/399266
Jul. 4, 2002 (JP) ..... 2002/195355

(51) Int. Cl.[7] ..... G03G 15/00
(52) U.S. Cl. ..... 399/12; 399/90
(58) Field of Search ..... 399/12, 13, 24, 399/25, 31, 90, 111

(56) References Cited

U.S. PATENT DOCUMENTS

| | | | | |
|---|---|---|---|---|
| 5,221,943 | A | 6/1993 | Hasegawa | 355/245 |
| 5,331,372 | A | 7/1994 | Tsuda et al. | |
| 5,678,121 | A * | 10/1997 | Meetze et al. | 399/12 |
| 5,708,922 | A | 1/1998 | Azuma et al. | 399/111 |
| 5,745,823 | A | 4/1998 | Goto et al. | 399/111 |
| 5,893,006 | A | 4/1999 | Kanno et al. | 399/13 |
| 5,937,237 | A | 8/1999 | Nonaka et al. | 399/106 |
| 5,937,239 | A | 8/1999 | Watanabe et al. | 399/111 |
| 6,011,941 | A | 1/2000 | Takashima et al. | 399/111 |
| 6,101,348 | A | 8/2000 | Nonaka et al. | 399/103 |
| 6,347,195 | B1 * | 2/2002 | Saiki et al. | 399/12 |
| 6,349,182 | B2 * | 2/2002 | Otsubo et al. | 399/12 |
| 2002/0025185 | A1 | 2/2002 | Ito et al. | 399/111 |
| 2002/0025186 | A1 | 2/2002 | Karakama et al. | 399/25 |
| 2002/0031359 | A1 | 3/2002 | Karamama et al. | 399/111 |
| 2002/0034357 | A1 | 3/2002 | Watanabe et al. | 399/12 |

FOREIGN PATENT DOCUMENTS

| | | | | |
|---|---|---|---|---|
| EP | 0 770 936 | | 5/1997 | |
| EP | 0 821 445 | | 1/1998 | |
| EP | 0 827 048 | | 3/1998 | |
| EP | 1298502 | A1 * | 4/2003 | G03G/21/18 |
| JP | 4-67054 | | 3/1992 | |
| JP | 09-179476 | | 7/1997 | |
| JP | 2002-072782 | | 3/2002 | |
| JP | 2002-072783 | | 3/2002 | |

(Continued)

*Primary Examiner*—Robert Beatty
(74) *Attorney, Agent, or Firm*—Fitzpatrick, Cella, Harper & Scinto

(57) ABSTRACT

A process cartridge includes a frame body, a substrate having a memory element, and a cartridge electrical contact and a cartridge pushing portion provided on the frame body. An electrophotographic image forming apparatus on which the process cartridge is loaded includes a main body electrical connector and main body electrical contacts. The cartridge pushing portion moves the main body electrical connector so that the process cartridge moves in a direction to be electrically connected with the cartridge electrical contact when the process cartridge is loaded on the electrophotographic image forming apparatus. The cartridge pushing portion operates so as to give a pushing force for pushing the main body electrical contact in a direction to be electrically connected with the cartridge electrical contact. In this way, the main body electrical contact and the cartridge electrical contact can be stably reliably brought into contact.

23 Claims, 27 Drawing Sheets

FOREIGN PATENT DOCUMENTS

| | | |
|---|---|---|
| JP | 2002-072784 | 3/2002 |
| JP | 2002-072823 | 3/2002 |
| JP | 2002-072824 | 3/2002 |
| JP | 2002-072825 | 3/2002 |

* cited by examiner

PROCESS CARTRIDGE AND ELECTROPHOTOGRAPHIC IMAGE FORMING APPARATUS HAVING ELECTRICAL CONNECTION FOR MEMORY

BACKGROUND OF THE INVENTION

1. Field of the Invention

The present invention relates to a process cartridge and an electrophotographic image forming apparatus detachably attachable with the process cartridge.

2. Related Background Art

Examples of an electrophotographic image forming apparatus includes, for example, an electrophotographic copying machine, an electrophotographic printer (for example, a LED printer, a laser printer and the like), an electrophotographic facsimile, an electrophotographic word processor and the like.

Further, the process cartridge includes an electrophotographic photosensitive body and at least one of charging means, developing means and cleaning means that are integrally turned into a cartridge as process means so as to be detachably attachable with an electrophotographic image forming apparatus main body. Or, furthermore, at least developing means and the electrophotographic photosensitive body are integrally turned into a cartridge as process means and detachably attachable with the electrophotographic image forming apparatus main body.

Conventionally, in the electrophotographic image forming apparatus using an electrophotographic image forming process, a process cartridge system is adopted, wherein an electrophotographic photosensitive body and process means acting on the electrophotographic photosensitive body are integrally incorporated into a cartridge, and this cartridge is made detachable and attachable with the image forming apparatus main body. According to this process cartridge system, maintenance of the apparatus can be performed by a user himself or herself without depending on a service person, so that operability can be exceptionally improved. Hence, this process cartridge system is widely used in the image forming apparatus.

Further, in this type of the process cartridge system, for example, as described in Japanese Patent Laid-Open No. 9-179476, a process cartridge system is proposed, wherein storage means such as an IC memory and the like for storing information to be transmitted to the image forming apparatus main body is mounted on the process cartridge, and the information is exchanged with the apparatus main body when the process cartridge is loaded on the apparatus main body, so that the using conditions and the like of the process cartridge are reported to a control portion of the apparatus main body. Further, a lot number of the process cartridge, a characteristic of the image forming apparatus, and a characteristic of the process means are registered in the storage means mounted on the process cartridge, maintenance of the image forming apparatus or the process cartridge becomes easy, and further, an image forming control was performed according to the information registered in the storage means, so that the image forming operation was performed under the best condition.

In the image forming apparatus adopting such a process cartridge, as connecting means for electrically connecting the storage means mounted on the process cartridge and the apparatus main body, there are available a contact type for connection by using a contact by means of a connector or a spring material and a non-contact type for communication by using a light-emitting element and a light-receiving element or by a wireless method by means of magnetic induction of inductor inductance via a magnetic core. Among these means, contact type connecting means using the spring material is simple in the constitution, is advantageous cost-wise and is generally used.

However, in the above-described conventional art using the contact type connecting means, the electrical connection between the storage means of the process cartridge and the image forming apparatus main body is sometimes unstable as described below.

The process cartridge attached onto the apparatus main body generates movement in a rotational direction with a photosensitive body drum as a center and movement in a thrust direction of the photosensitive body drum at the operation starting time and the operation stopping time of the apparatus. Usually, an electrical contact pressure is secured in a state in which a driving force is applied to the process cartridge from the apparatus main body. For this reason, in a state in which a driving force is applied and not applied, there was a possibility of causing a change in the posture of the process cartridge, thereby causing irregularity of electrical contact pressure.

Hence, the present invention has been made in view of the above-described unsolved problems of the prior art.

SUMMARY OF THE INVENTION

An object of the present invention is to provide a process cartridge and an electrophotographic image forming apparatus in which a main body electrical contact provided on an apparatus main body and a cartridge electrical contact can be stably and reliably brought into contact when the process cartridge has been attached onto the electrophotographic image forming apparatus.

Another object of the present invention is to provide a process cartridge and an electrophotographic image forming apparatus in which the accuracy of a position to which a cartridge electrical contact is brought into contact with a main body electrical contact is improved when the process cartridge has been attached onto an electrophotographic image forming apparatus main body.

A further object of the present invention is to provide a process cartridge and an electrophotographic image forming apparatus in which a main body electrical contact provided on an apparatus main body and a cartridge electrical contact are stably and reliably brought into contact when the process cartridge is being attached onto the electrophotographic image forming apparatus main body.

A still further object of the present invention is to provide a process cartridge and an electrophotographic image forming apparatus in which a main body electrical contact provided on an apparatus main body and a cartridge electrical contact provided on an apparatus main body are stably and reliably brought into contact without being influenced by a change in the posture of the process cartridge due to the presence or absence of the transmission of a driving force and by any irregularity in the dimension of parts.

A further object of the present invention is to provide a process cartridge and an electrophotographic image forming apparatus which can prevent wearing and deformation.

A still further object of the present invention is to provide a process cartridge and an electrophotographic image forming apparatus, with improved operability of a jam process.

Another object of the present invention is to provide a process cartridge having main body electrical connection means movably provided and a main body electrical contact provided on the main body electrical connecting means, having:

an electrophotographic photosensitive body drum;

process means acting on the electrophotographic photosensitive body drum;

a frame body;

a memory element for storing information;

a cartridge electrical contact, which is electrically connected with the memory element and is electrically connected with the main body electrical contact when the process cartridge is attached onto an apparatus main body;

a substrate provided on the frame body, the substrate body having the memory element and the cartridge electrical contact; and a cartridge pushing portion provided on the frame body, allowing the main body electrical connecting means to move so that the main body electrical contact moves in a direction to be electrically connected with the cartridge electrical contact when the process cartridge is loaded on the apparatus main body, and giving a pushing force for pushing the main body electrical contact in a direction to be electrically connected with the cartridge electrical contact after the main body electrical contact and the cartridge electrical contact are electrically connected.

Further, another object of the present invention is to provide a process cartridge detachably attachable with an electrophotographic image forming apparatus main body having main body electrical connecting means movably provided and a main body electrical contact provided on the main body electrical connecting means, the process cartridge having:

an electrophotographic photosensitive body drum;

process means acting on the electrophotographic photosensitive body drum;

a frame body;

a memory element for storing information;

a cartridge electrical contact electrically connected with the memory element, the cartridge electrical contact being connected with the main body electrical contact when the process cartridge is attached onto an apparatus main body, a substrate provided on the frame body, the substrate having the memory element and the cartridge electrical contact, the substrate being provided here on the upper surface side of the frame body when the process cartridge is loaded on the apparatus main body;

a cartridge pushing portion provided on the frame body, allowing the main body electrical connecting means to move so that the main body electrical contact is moved in a direction to be electrically connected with the cartridge electrical contact when the process cartridge is being attached onto the apparatus main body, and giving a pushing force for pushing the main body electrical contact in a direction to be electrically connected with the cartridge electrical contact after the main body electrical contact is electrically connected with the cartridge electrical contact, the cartridge pushing portion being provided here on a top end of the frame body in the attaching direction of the process cartridge when the cartridge process is attached onto the apparatus main body; and a cartridge guide portion provided on the frame body, the cartridge guide portion engaging with a main body guide portion provided on the main body electrical connecting means and performing a positioning of the main body electrical connecting means when the process cartridge is being attached onto the apparatus main body, the cartridge guide portion being provided here by protruding on the upper surface side of the frame body when the process cartridge was loaded on the apparatus main body.

A further object of the present invention is to provide an electrophotographic image forming apparatus detachably attachable to a process cartridge and forming an image on a recording medium, the electrophotographic image forming apparatus having:

(i) main body electrical connecting means movably provided;

(ii) a main body electrical contact provided on the main body electrical connecting means;

(iii) attaching means for removably loading the process cartridge having: an electrophotographic photosensitive body drum; process means acting on the electrophotographic photosensitive body drum; a frame body; a memory element for storing information; a cartridge electrical contact electrically connected with the memory element, the cartridge electrical point being electrically connected with the main body electrical contact when the process cartridge is attached onto the electrophotographic image forming apparatus; a substrate provided on the frame body, the substrate having the memory element and the cartridge electrical contact; a cartridge pushing portion provided on the frame body, allowing the main body electrical connecting means to move so that the main body electrical contact is moved in a direction to be electrically connected with the cartridge electrical contact when the process cartridge is attached onto an apparatus main body and giving a pushing force for pushing the main body electrical contact in a direction to be electrically connected with the cartridge electrical contact after the main body electrical contact is electrically connected with the cartridge electrical contact; and (iv) conveying means for conveying the recording medium.

A further object of the present invention is to provide an electrophotographic image forming apparatus detachably attachable with a process cartridge and forming an image on a recording medium, the electrophotographic image forming apparatus having:

(i) a main body electrical contact to be electrically connected with a cartridge electrical contact when the process cartridge is attached onto a main body of the electrophotographic image forming apparatus;

(ii) a first movable member rotatably provided for the main body electrical contact on the apparatus main body;

(iii) a first spring material provided between the first movable member and the apparatus main body, the first spring material biasing the first movable member in a direction where the main body electrical contact separates from the cartridge electrical contact;

(iv) a second movable member rotatably provided for the first movable member for supporting the main body electrical contact point;

(v) a second spring material provided between the first movable member and the second movable member, the second spring material energizing the second movable member in a direction where the main body electrical contact is electrically connected with the cartridge electrical contact;

(vi) loading means for removably loading the process cartridge, having: an electrophotographic photosensitive body drum; process means acting on the electrophotographic photosensitive body drum; a frame body; a memory element for storing information; a cartridge electrical contact electrically connected with the memory element, the cartridge electrical point being electrically connected with the main body electrical contact when the process cartridge is attached onto the main body of the electrophotographic image forming apparatus; a substrate provided on the frame body, the substrate having the memory element and the cartridge electrical contact; a cartridge pushing portion provided on the frame body allowing the main body electrical connecting means to move so that the main body electrical contact is moved in a direction to be electrically connected with the cartridge electrical contact when the process cartridge is being attached onto the apparatus main body and giving a pushing force for pushing the main body electrical contact in a direction to be electrically connected with the cartridge electrical contact after the main body electrical contact is electrically connected with the cartridge electrical contact; and (vii) conveying means for conveying the recording medium.

A further object of the present invention is to provide a process cartridge detachably attachable to an electrophotographic image forming apparatus having main body electrical connecting means movably provided and a main body electrical contact provided on the main body electrical connecting means, the process cartridge having:

an electrophotographic photosensitive body drum;

process means acting on the electrophotographic photosensitive body drum;

a frame body;

a memory element for storing information;

a cartridge electrical contact electrically connected with the memory element, the cartridge electrical contact being electrically connected with the main body electrical contact when the process cartridge is attached onto the apparatus main body;

a substrate provided on the frame body, the substrate having the memory element and the cartridge electrical contact;

a cartridge guide portion provided by protruding from the frame body engaging with a main body guide portion when the process cartridge is being attached onto an apparatus main body and performing positioning of the main body electrical connecting means in a direction to cross the mounting direction of the process cartridge and abutting against the main body electrical connecting means and guiding the main body electrical contact to the cartridge electrical contact portion in a direction where the main body electrical contact is electrically connected with the cartridge electrical contact; and a cartridge pushing portion, provided on the frame body, allowing the main body electrical connecting means to move so that the main body electrical contact is moved in a direction to be electrically connected with the cartridge electrical contact when the process cartridge is being attached onto the apparatus main body and giving a pushing force for pushing the main body electrical contact in a direction to be electrically connected with the cartridge electrical contact after the main body electrical contact is electrically connected with the cartridge electrical contact.

A still further object of the present invention is to provide an electrophotographic image forming apparatus detachably attachable to a process cartridge and forming an image on the recording medium, the electrophotographic image forming apparatus having:

(i) main body electrical connecting means movably provided;

(ii) a main body electrical contact provided on the main body electrical connecting means;

(iii) a main body guide portion provided on the main body electrical connecting means;

(iv) an electrophotographic photosensitive body drum; process means acting on the electrophotographic photosensitive body drum; a frame body; a memory element for storing information; a cartridge electrical contact electrically connected with the memory element, the cartridge electrical point being electrically connected with the main body electrical contact when the process cartridge is loaded on the electrophotographic image forming apparatus; a substrate provided on the frame body, the substrate having the memory element and the cartridge electrical contact; a cartridge guide portion, provided by protruding from the frame body, engaging with a main body guide portion when the process cartridge is loaded on a main body of the electrophotographic image forming apparatus and performing positioning of the main body electrical connecting means in a direction to cross the mounting direction of the process cartridge and abutting against the main body electrical connecting means and guiding the main body electrical contact to the cartridge electrical contact portion in a direction where the main body electrical contact is electrically connected with the cartridge electrical contact; a cartridge pushing portion provided on the frame body allowing the main body, electrical connecting means to move so that the main body electrical contact is moved in a direction to be electrically connected with the cartridge electrical contact when the process cartridge is loaded on the apparatus main body and giving a pushing force for pushing the main body electrical contact in a direction to be electrically connected with the cartridge electrical contact after the main body electrical contact is electrically connected with the cartridge electrical contact; and (v) conveying means for conveying the recording medium.

BRIEF DESCRIPTION OF THE DRAWINGS

FIG. 7A is a perspective view of the whole. FIG. 7B is a perspective view of a contact holder of the electrical connecting means;

FIG. 18A shows a perspective view of the electrical connecting means in a state where the contact holder is separated from a holder holding portion. FIG. 18B is a perspective view of the electrical connecting means in a state where the contact holder is adsorptively held by the holder holding portion;

DESCRIPTION OF THE PREFERRED EMBODIMENTS

Hereinafter, preferred embodiments of the present invention will be described with reference to the drawings.

First Embodiment

A process cartridge and an electrophotographic image forming apparatus detachably attachable with the process cartridge which are constituted based on the present invention, and subsequently, storage means as a main board of the process cartridge and electrical connecting means of an apparatus main body side will be described with reference to FIG. 1 to FIG. 7. Hereinafter, in the present embodiment, a description will be provided by taking an electrophotographic laser beam printer as an example.

Figure 1:
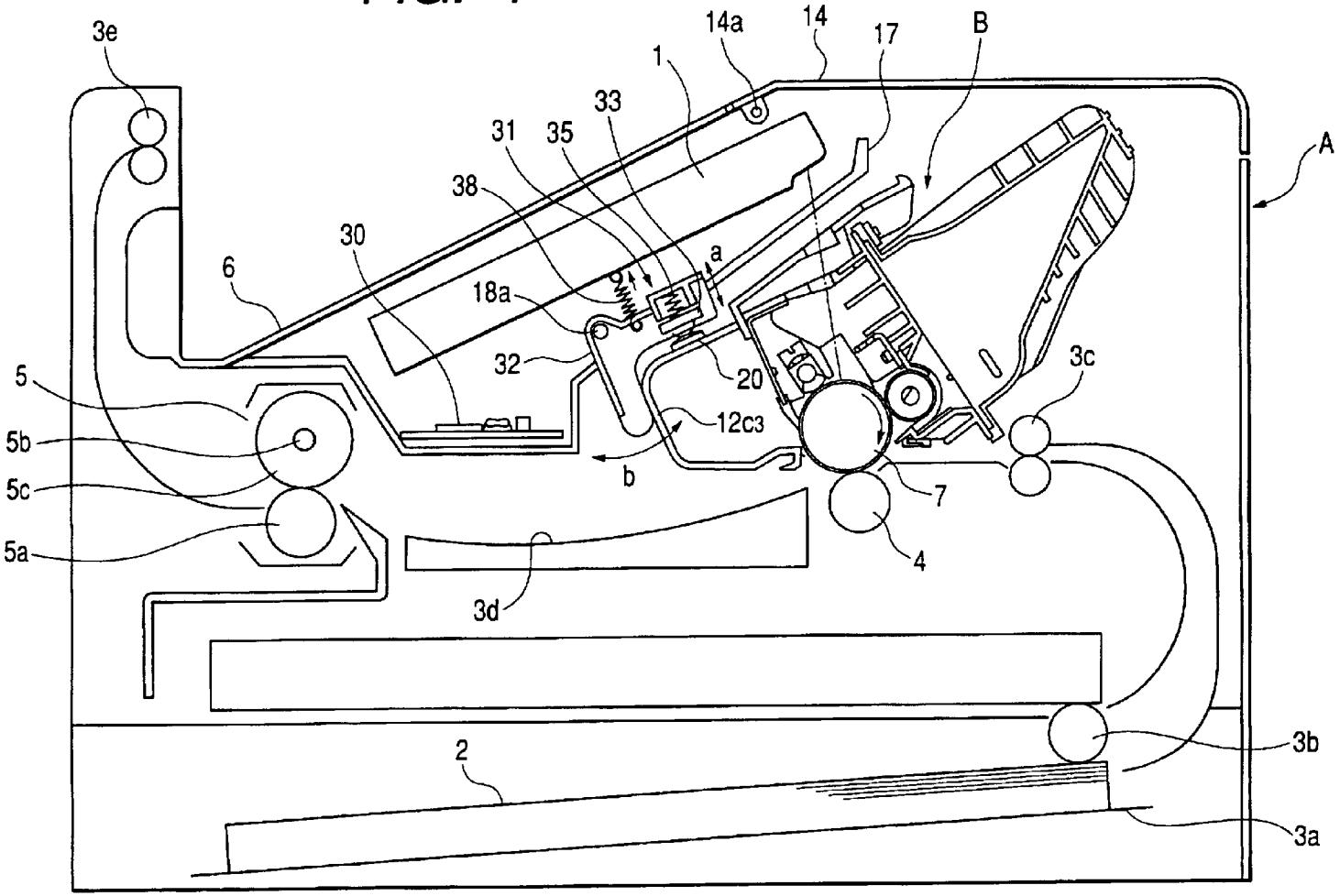
FIG. 1 is a schematic block diagram showing the constitution of a first embodiment of an image forming apparatus of the present invention.

An image forming apparatus A, as shown in FIG. 1, forms a latent image on the photosensitive body drum by irradiating a cylindrical electrophotographic photosensitive body 7 (hereinafter, referred to simply as a photosensitive body drum) with a laser beam image based on image formation from an optical system (scanner), and develops this latent image to form a developer image by using the developer.

Synchronizing with the formation of the developer image, a recording medium 2 such as a recording paper, an OHP sheet, a cloth and the like is conveyed from a recording medium cassette 3*a* by a pickup roller 3*b*, a pair of conveying rollers 3*c* and the like. In the image forming part constituting a cartridge as a process cartridge B, the developer image formed on the photosensitive body drum 7 is applied with voltage on a transferring roller 4, so that the image is transferred on the recording medium 2. The recording medium 2 on which the developer image was transferred is guided by a guiding plate 3*d* and is conveyed to a fixing means 5. This fixing means 5 comprises a fixing roller 5*c*, and a driving roller 5*a* having a heater 5*c* therein , and fixes the developer image by applying heat and pressure on the recording medium 2 which passes therethrough. The recording medium 2 on which the developer image was fixed is conveyed through a reversal-conveying path, and is discharged to a discharge tray 6 outside of the apparatus via a pair of discharging rollers 3*e*.

The process cartridge B comprises the photosensitive body drum 7 and at least one process means. Here, as the process means, there are available, for example, charging means (8) which charges the electrophotographic photosensitive body, developing means (10) which develops the latent image formed on the electrophotographic photosensitive body, and cleaning means (11) which cleans the developer remained on the surface of the electrophotographic photosensitive body and the like (see FIG. 3).

Figure 3:
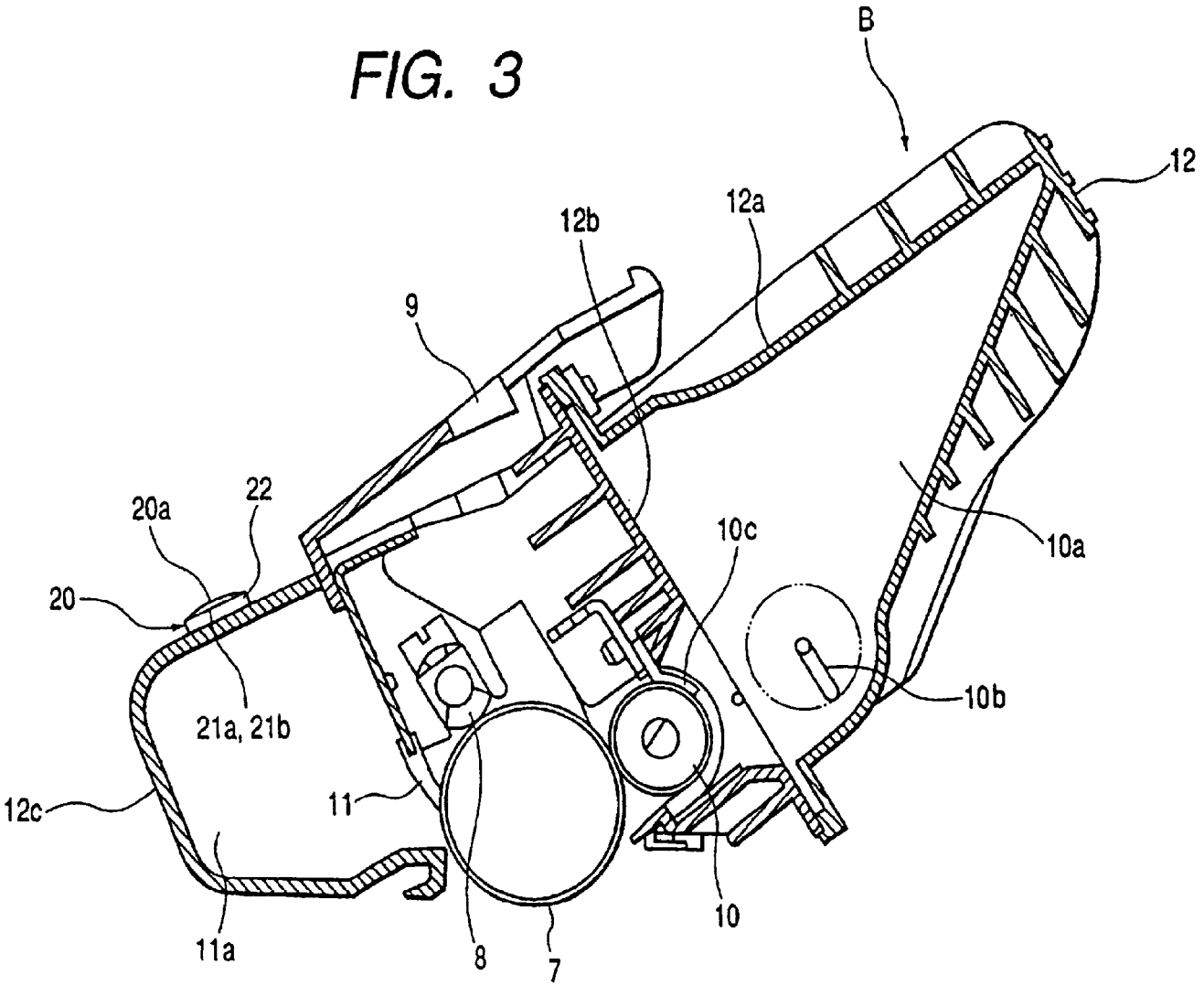
FIG. 3 is a cross-sectional view of a process cartridge in the first embodiment of the image forming apparatus of the present invention.

The process cartridge of the present embodiment is constituted as shown in FIG. 3. The photosensitive body drum 7 having a photosensitive layer on its peripheral surface is rotated, and its surface is uniformly charged by a charging roller 8, which is charging means. Subsequently, an image information light from the optical system 1 is exposed on the photosensitive body drum 7 via an exposure-opening portion 9 provided on the process cartridge B so as to form the latent image. The latent image formed on the photosensitive body drum 7 is developed by using the developer by the developing means (10).

The developing means (10) conveys the developer, which is within a developer storing portion 10*a*, by a developer delivery portion 10*b*, and allows it to be adhered on the developing roller 10, which is built-in with a fixed magnet. The developer layer, given a frictional charging charge by a developing blade 10*c* is formed on the surface of the developing roller 10. The developer is transferred on the photosensitive body drum 7 according to the latent image, so that the developer image is formed and visualized.

A voltage having a polarity in reverse to the developer image is applied on the transferring roller 4 provided on the apparatus main body, and the developer image is transferred onto the recording medium 2. After that, the developer remaining on the photosensitive body drum 7 is scraped off by the cleaning blade 11, and the scraped developer is collected into a removed developer collector 11*a*.

Note that the above-described photosensitive body drum 7 and process means (8, 10, 11 . . . ) are stored and held within a cartridge frame body 12. The cartridge frame body 12 includes a developer storing frame body 12*a* for forming the developer storing portion 10*a* for storing the developer, a developing apparatus frame body 12*b* for holding the developing roller 10 and the like, and a cleaning frame body 12*c* for holding the photosensitive body drum 7 and cleaning means and forming the removed developer collector 11*a*. Further, the developer storing frame body 12*a* and the developing apparatus frame body 12*b* are unified by welding and the like, which is oscillationally joined to the cleaning frame body 12*c*, thereby constituting the process cartridge B.

Figure 5:
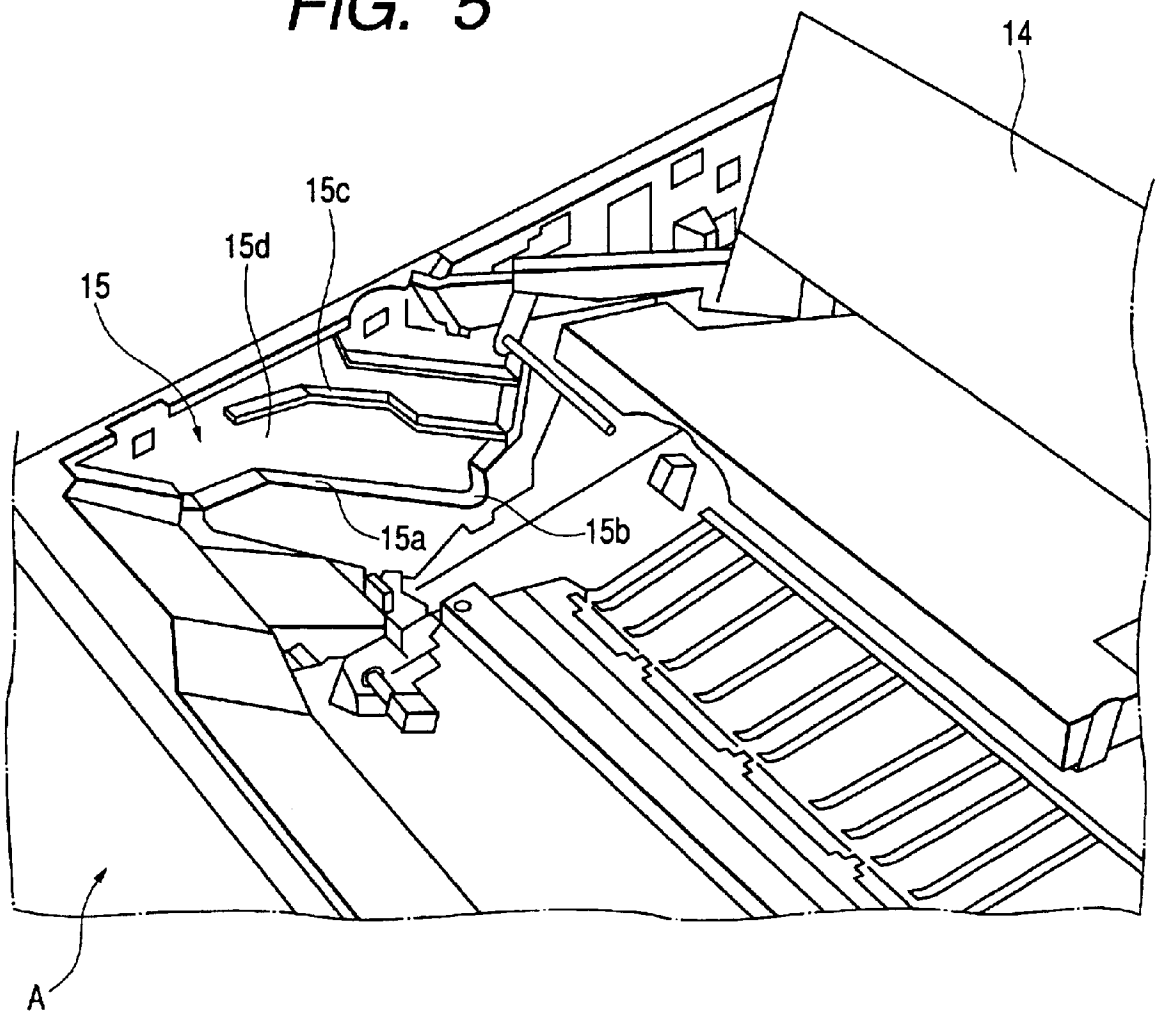
FIG. 5 is a schematic perspective view showing a cartridge loading region in the first embodiment of the present invention.
Figure 6:
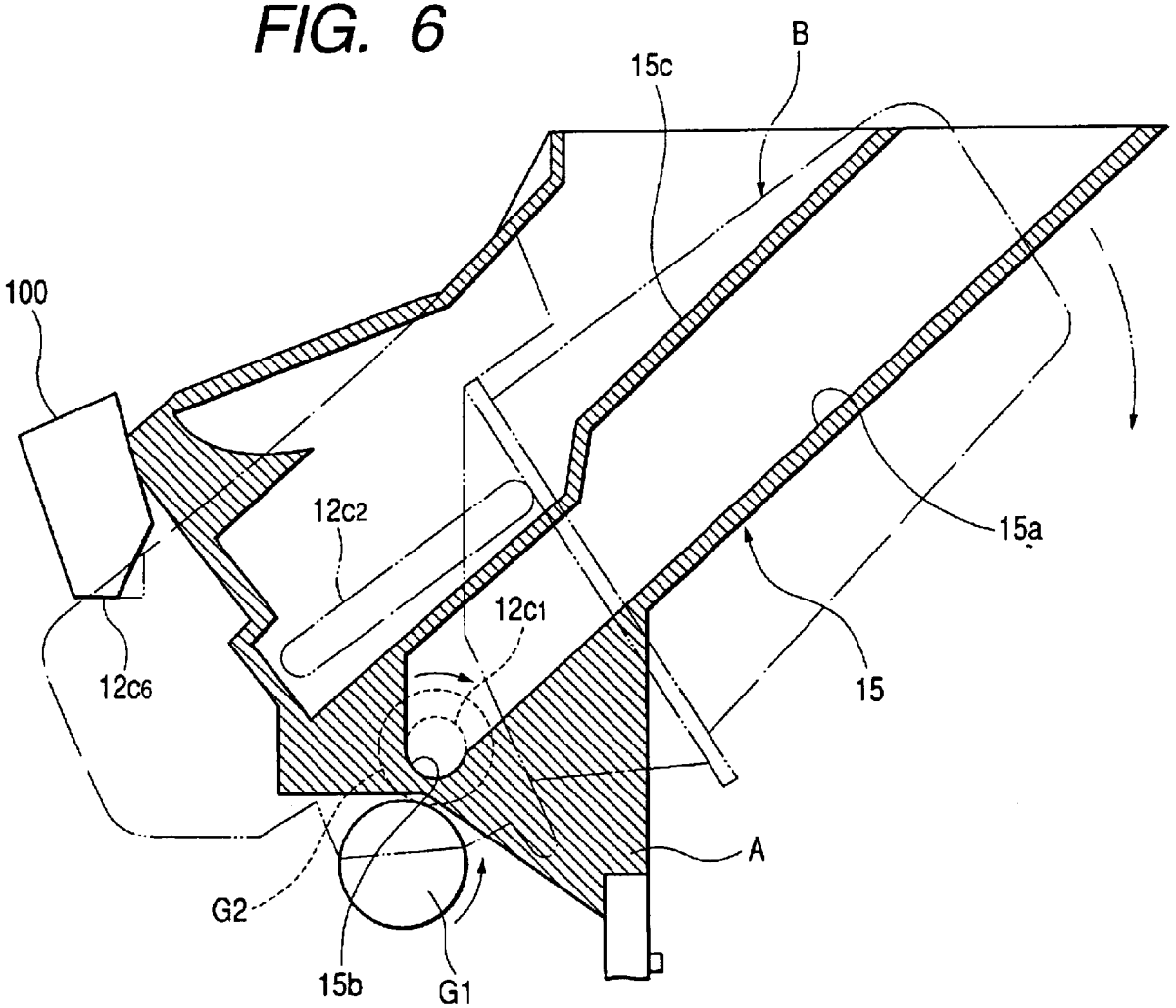
FIG. 6 is a schematic diagram for explaining a force; which the cartridge receives in the cartridge loading region in the first embodiment of the present invention.

The process cartridge B is detachably attached onto cartridge attaching means provided on the apparatus main body A (see FIG. 1, FIG. 5 and FIG. 6). The cartridge attaching means is provided on a region accessible by opening (see FIG. 1 and FIG. 2) a cartridge cover (openable and closable cover) 14 that is openable and closable about an axis 14*a* with respect to the casing of the apparatus A. In FIG. 5, which shows a cartridge loading region with the cartridge cover 14 in a state of being opened in a perspective view, a cartridge loading guide member 15 is mounted by opposing it to both of the left and right wall surfaces of the cartridge loading region. The left opposing wall surface is denoted by 15*d* and the right opposing wall surface is not shown, (FIG. 5 shows one side only) The left and right loading guide members 15 comprise guide portions 15*a*, 15*c*, which are guides when the process cartridge B is inserted, and a cartridge positioning portion 15*b*, for positioning the process cartridge B, which is continuously formed on the guide portion 15*a*, respectively. Note that the guide portion 15*c* is arranged by bending downward in the vicinity of the cartridge positioning portion 15*b*.

The guide portion 15*a* guides a boss 12*c*1 (see FIG. 4), which is formed on the cleaning frame body 12*c* of the cartridge frame body 12 of the process cartridge and protrudes to both outsides longitudinally. Further, the guide portion 15*c* guides a slender-shaped longitudinal guide portion 12*c*2 (see FIG. 4), which is provided similarly by externally protruding upward of the boss 12*c*1 of the cartridge frame body 12. The cartridge positioning portion 15*b*, continuing to the guide portion 15*a*, engages with the boss 12*c*1 of the cartridge frame body 12, and performs positioning for the apparatus main body of the process cartridge B.

When the process cartridge B is attached onto the cartridge attaching means formed as described above, a cartridge cover 14 is opened, and the boss 12*c*1 and the longitudinal guide portion 12*c*2 of the cartridge frame body 12 are inserted, respectively along the guide portion 15*a* and the guide portion 15*c*. The cartridge frame body 12 is guided by guide portions 15*a*, 15*c*, and the boss 12*c*1 of the cartridge frame body 12 is fitted to the cartridge positioning portion 15*b* so as to be positioned. Note that, at this time, the longitudinal guide portion 12*c*2 of the cartridge frame body 12 is positioned in a state of being separated from the guide portion 15*c*. In this way, the process cartridge B is positioned on the apparatus main body A (see FIG. 6). By closing the cartridge cover 14, the process cartridge B is loaded on the apparatus main body A.

When the process cartridge B is attached onto the cartridge loading means in this way, as shown in FIG. 6, a helical gear G2 provided on an end portion of the photosensitive body drum 7 held by the cartridge gear B is engaged with a helical gear G1 provided on the apparatus main body A. Thereafter, when the helical gear G1 rotates (clockwise in FIG. 6), the photosensitive body drum 7 rotates via the helical gear G2. In this way, a driving force of the apparatus main body A is transmitted to the process cartridge B.

At this time, with the boss 12*c*1 provided on both sides on the same axis as the photosensitive body drum 7 as a center, a force to rotate the process cartridge B clockwise, similar to the rotational direction of the photosensitive body drum 7, acts on the process cartridge B. An abutting concave portion 12*c*6 (FIGS. 4 and 6) provided on the upper surface of the cleaning frame body 12*c* abuts against a solidly fixed portion 100 (FIG. 6) provided on the apparatus main body A. In this way, a position of the cleaning frame body 12*c* of the process cartridge B for the apparatus main body A is set.

Further, in a longitudinal direction of the process cartridge B (in a direction orthogonal to FIG. 6), a thrust force acts between the helical gear G1 provided on the apparatus main body A and the helical gear G2 of the end portion of the photosensitive body drum 7. Hence, a force to move the process cartridge B in the thrust direction (thrust direction of the photosensitive body drum 7) acts. That is, in FIG. 5, a force works in a direction to advance toward the one wall surface 15*d* for the process cartridge B. In this way, in the case where there exists a slight gap between the side surface of the cartridge frame body 12 of the process cartridge B and the apparatus main body A, when a driving force is applied on the process cartridge B, by this driving force, the process cartridge B moves slightly toward the thrust direction until the boss 12*c*1 butts against the wall surface 15*d*. Further, on the contrary, when a state of the driving force being applied on the cartridge B turns into a state of the driving force being not applied, the force being applied on each butting portion ceases to work, and the process cartridge B moves in a direction to separate from the butting portion. In this way, the position and the posture of the process cartridge B become different according to the operating time and the stopping time of the apparatus main body A, and every time the apparatus main body A performs the driving and stopping operation, the position of the process cartridge B moves.

Note that the above-described boss 12*c*1 is a protruding member provided by externally protruding from both sides (of the cleaning frame body 12*c*) of the cartridge frame body 12 on the same axis line as the axis line of the photosensitive body drum 7. This protruding member may be a member where a drum axial portion for supporting the photosensitive body drum 7 on the cartridge frame body 12 (the cleaning frame body 12*c*) externally protrudes or a member where a part of the cartridge frame body 12 (or the cleaning frame body 12*c*) externally protrudes.

In the above described description regarding the driving, though the driving transmitting means transmitting a driving force toward the process cartridge were described as the helical gears, in the case of the constitution where the driving force transmitted toward the process cartridge from the apparatus main body is transmitted by using a coupling mechanism, the same action is performed.

Next, the storage means to be loaded on the process cartridge will be described by using FIG. 3 and FIG. 4.

The storage means (memory means) 20 is provided on the external surface of the cartridge frame body 12 of the process cartridge B. Particularly, as shown in FIG. 3 and FIG. 4, the storage means is mounted on the upper surface of the cartridge frame body 12 (the cleaning frame body 12*c*). This storage means 20, as shown clearly in FIG. 4, has specifically a memory chip 20*a* such as RAM, ROM and the like and contact portions 21*a*, 21*b* of both sides thereof on a substrate 22. Further, in this memory chip 20*a* is inputted in advance the necessary information (for example, a lot number of the process cartridge, an initial value and a using status, such as process conditions, characteristic of the image forming apparatus and characteristic of the process means and like). When the process cartridge B is loaded on the apparatus main body A, the information is exchanged with the apparatus main body side, so that the state, such as using conditions-and the like, of the process cartridge B is communicated to a control substrate 30 of the apparatus main body A, which is useful for the image forming operation and used for the purpose of displaying to an operator the status of the process cartridge. Further, since the memory chip 20*a* can be written on even during use, writing can be performed at any time as the occasion demands.

The contact portions 21*a*, 21*b* are for the purpose of connecting with electrical contacts of the apparatus main body side in order to perform the writing on the memory chip 20*a*, and a gold plated bronze plate is mounted on the substrate 22.

Figure 4:
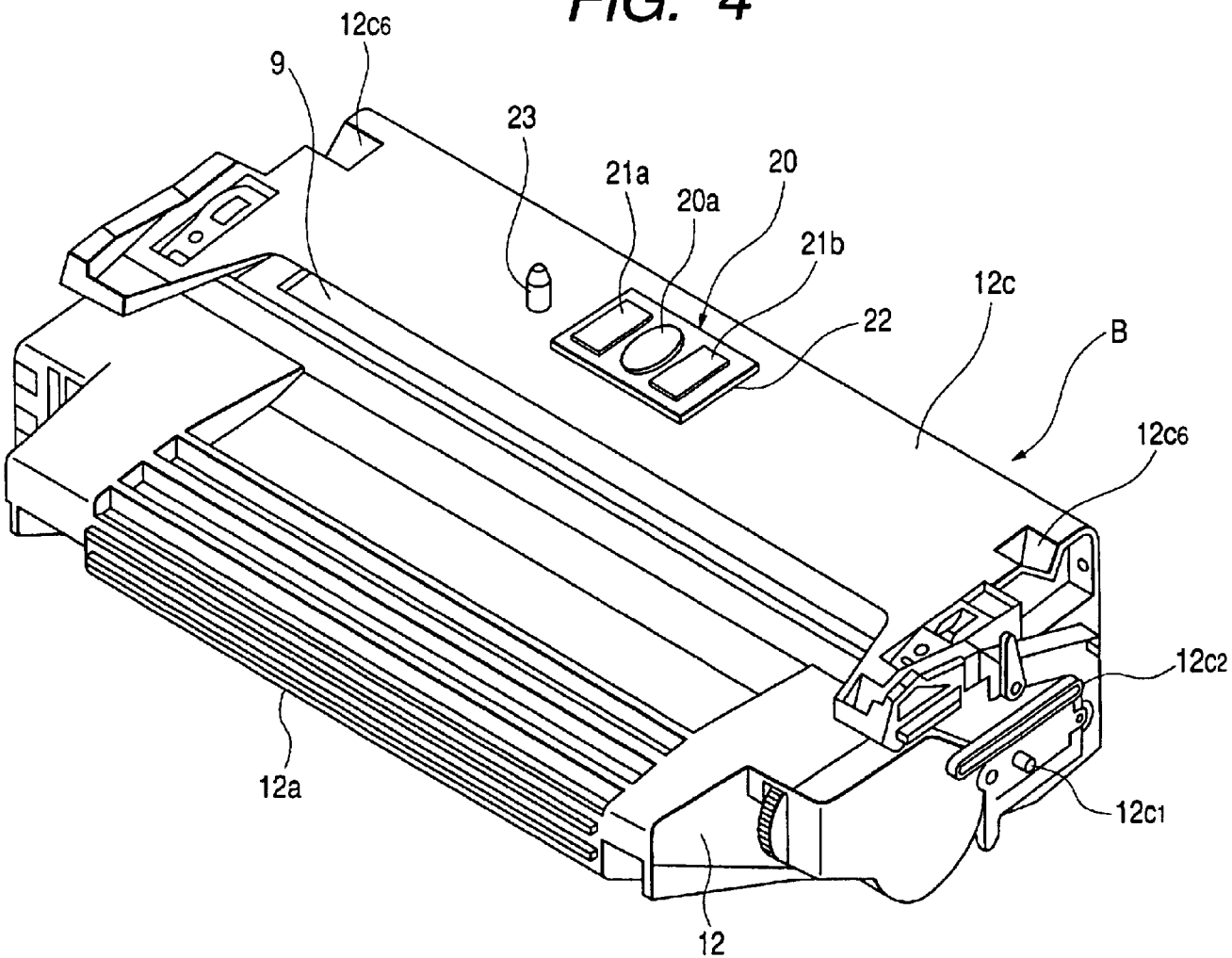
FIG. 4 is an external perspective view of the process cartridge in the first embodiment of the present invention.

Further, on the upper surface of the cartridge frame body 12 of the process cartridge B is provided a guide pin 23 adjacent to the storage means 20 (see FIG. 4). When the process cartridge B is being attached onto the apparatus main body A, this guide pin 23 is arranged at a position to engage with a guide rib 36 of electrical connecting means 31 in order to decide the position of the thrust direction of the electrical connecting means 30, to be described later, of the apparatus main body side.

Next, the constitution of the electrical connecting means provided on the apparatus main body side will be described by using FIG. 1, FIG. 2 and FIGS. 7A and 7B.

Figure 7A:
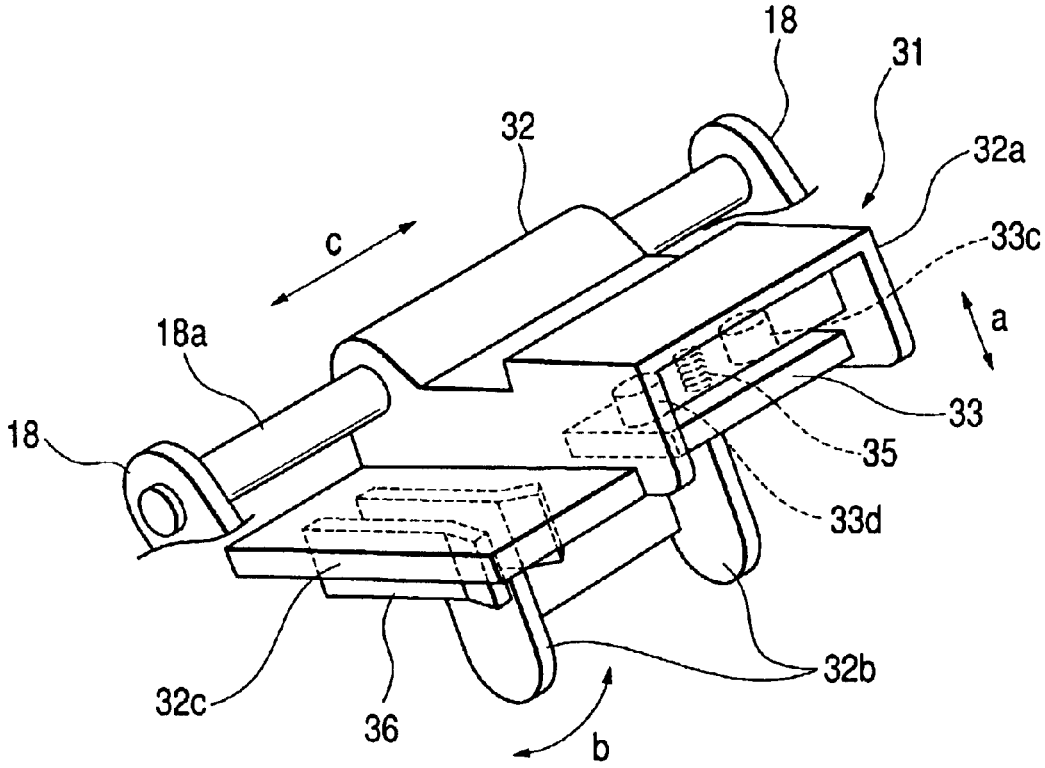
FIGS. 7A and 7B are views showing electrical connecting means in the first embodiment of the present invention.
Figure 7B:
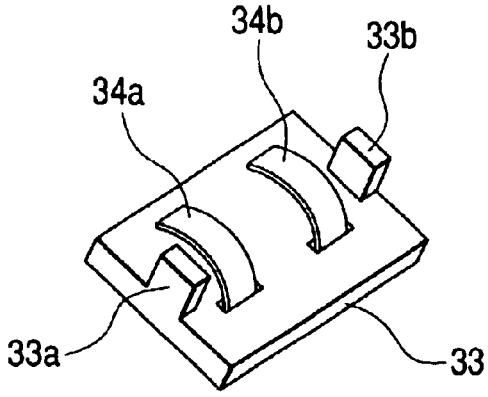

The electrical connecting means 31, as shown in FIG. 1, is arranged at a position opposing to the storage means 20 when the process cartridge B is attached onto the apparatus main body A. The electrical connecting means 31, as shown in FIGS. 7A and 7B, is constituted by a rotary arm 32 which is a first movable member formed almost in the shape of an L character and a contact holder 33 which is a second movable member. The rotary arm 32 is formed almost in the shape of an L character by a main body portion 32*a*, which movably holds parallel the contact holder 33, and a downward protruding portion 32*b*, which protrudes downward and is a connecting means abutting portion arranged so as to abut against a top end portion 12*c*3, which is a pushing member of the cartridge frame body 12, when the process cartridge B is attached. Further, on the lateral side of the main body portion 32*a* of the rotary arm 32 is integrally provided a guide portion 32*c*, on whose under surface side is formed a pair of guide ribs 36. This pair of guide ribs 36 is provided for the purpose of guiding and positioning the guide pin (engaging portion) provided on the process cartridge B. The direction from which the guide pin 23 advances is in an opened state so that the guide pin 23 can be reliably guided. The rotary arm 32 in its L character shaped bent portion is rotatably and sliderably supported in an axial direction (thrust direction) by an axial member 18*a* which is axially supported by a bearing member 18 provided on a frame portion 17 of the apparatus main body A.

Further, in the contact holder 33 to be held on the main body portion 32*a* of the rotary arm 32, as shown in FIG. 7B, are built-in the electrical contact portions 34*a*, 34*b* by being pressed into a boss (not shown), which are treated with gold plating on the plate spring member of phosphor bronze. Further, on the external side portion of the electrical contact portions 34*a*, 34*b* are formed convex portions 33*a*, 33*b*. The electrical contact portions 34*a*, 34*b* are connected with the control substrate 30 via a lead wire (not shown). When the contact holder 33 contacts the storage means 20, the electrical contact portions 34*a*, 34*b* are brought into contact with storage means contact portions 21*a*, 21*b*. The convex portions 33*a*, 33*b* are constituted so as to abut against the upper surface portion of the cleaning frame body 12*c*. The bosses 33*c*, 33*d* formed on the upper surface (in FIG. 7A) of the contact holder 33 slidably fit to holes provided on the main body portion 32*a* of the rotary arm 32. Hence, the contact holder 33 is movably mounted in parallel to the direction shown by an arrow mark a for the main body portion 32*a*. Between the contact holder 33 and the main body portion 32*a* is arranged a spring 35, which energizes the contact holder 33 in a protruding direction shown by the arrow mark a.

As described above, in the bent portion of the L-shaped rotary arm 32, the electrical connecting means 31 is rotatably and slidably supported in an axial direction (thrust direction) by an axial member 18*a* which is axially supported by the bearing member 18 provided on the frame portion 17 of the apparatus main body A. Hence, the electrical connecting means 31 can rotate in the direction shown by an arrow mark b, and further can rotate in the direction shown by an arrow mark c. Further, the rotary arm 32 is biased counterclockwise around an axial portion 18*a* by a spring 38 (see FIG. 1 and FIG. 2).

Next, a connecting constitution between the storage means 20 at the process cartridge loading time and the electrical connection means 31 of the apparatus main body side will be described.

Figure 2:
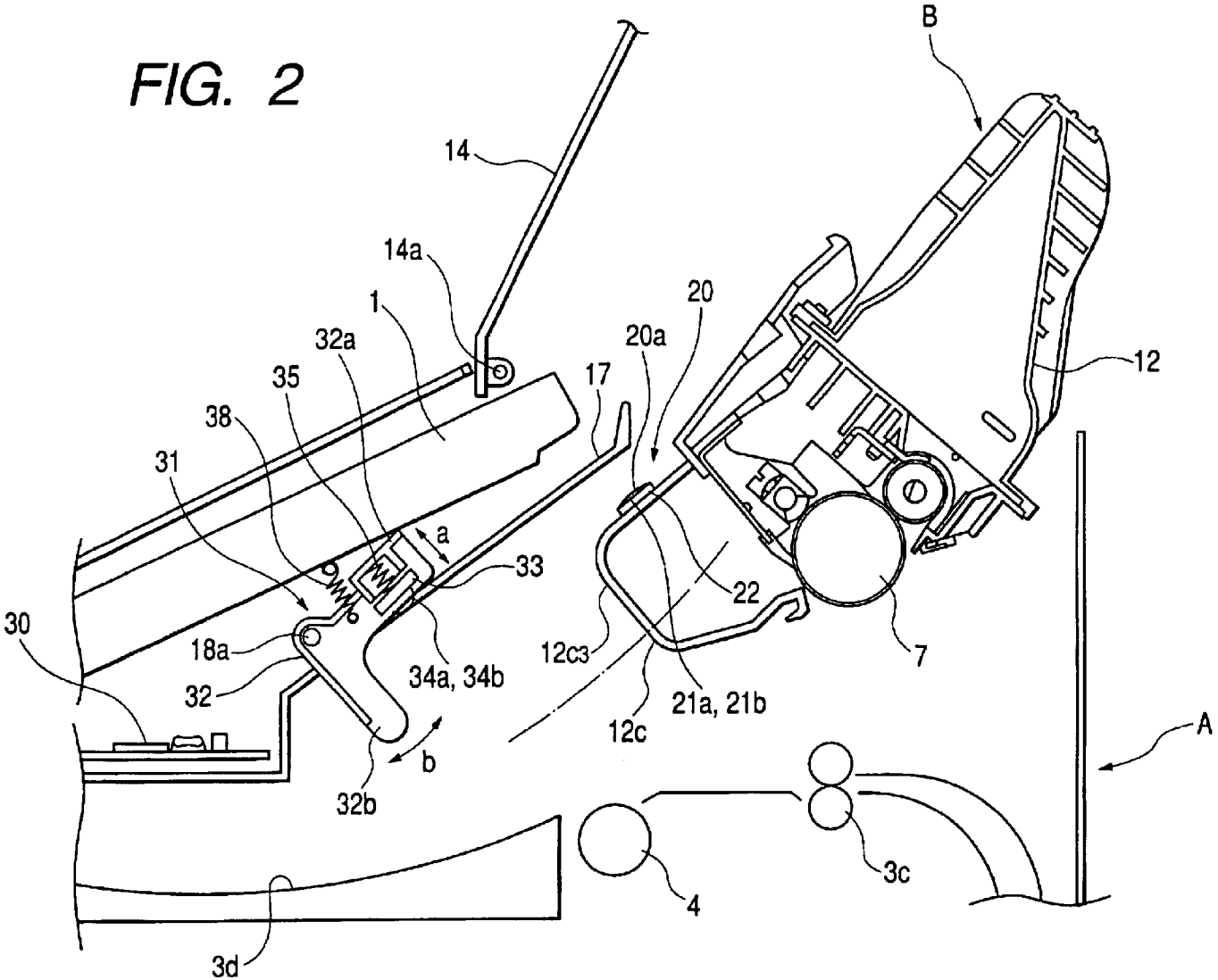
FIG. 2 is a enlarged block diagram showing components of the first embodiment of the image forming apparatus of the present invention.

When the process cartridge B is not attached onto the apparatus main body A, as shown in FIG. 2, the rotary arm 32 of the electrical connecting means 31 biased in a counterclockwise direction by an energizing force of the spring 38 with an axial member 18*a* as a center, and is at a standstill. In this way, the contact holder 33 held by the main body portion 32*a* of the rotary arm 32 and the electrical contact portions 34*a*, 34*b* are held in a shunting state upward of the frame portion 17.

When the process cartridge B is being attached onto a cartridge attaching region of the apparatus main body A and the process cartridge B is inserted, the top end portion 12*c*3 of the cartridge frame body 12 (the cleaning frame body 12*c*) abuts against the downward protruding portion 32*b* of the rotary arm 32. The downward protruding portion 32*b* is pushed clockwise corresponding to further insertion of the process cartridge B, so that the rotary arm 32 of the electrical connecting means 31 rotates clockwise by opposing the energizing force of the spring 38. When the process cartridge B is loaded on a predetermined cartridge loading region, the rotary arm 32 of the electrical connecting means 31 comes to a stand still at the position shown in FIG. 1.

At the rotational time of the rotary arm 32 of the electrical connecting means 31, the contact holder 33 held by the main body portion 32*a* of the rotary arm 32 moves clockwise at the same time. The electrical contact portions 34*a*, 34*b* comprising the spring member of the contact holder 33 are brought into contact with the storage means contact portions 21*a*, 21*b* of the process cartridge B. The convex portions 33*a*, 33*b* formed on the contact holder 33 abut against the upper surface portion of the cleaning frame body 12*c*. In this way, the contact holder 33 comes to a standstill at the position shown in FIG. 1. Here, a spring force of the spring 35, which biases the contact holder 33 in a direction to protrude downward in the drawing, is largely set to be equal to the sum of the spring forces of the electrical contact portions 34*a*, 34*b*. Hence, the convex portions 33*a*, 33*b* of the contact holder 33 abut against the cleaning frame body 12*c* by the spring force of the spring 35. In this way, since the convex portions 33*a*, 33*b* of the contact holder 33 directly abut against the cleaning frame body 12*c*, there is little positional shift due to the common difference of parts, and it is possible to obtain precise positional accuracy of the electrical contact portions 34*a*, 34*b* and the storage means contacts 21*a*, 21*b*. Note that the timing for the electrical contact portions 34*a*, 34*b* to contact the storage means contact portions 21*a*, 21*b* may be either during the time when the process cartridge B is attached onto the apparatus main body A or after the process cartridge B is attached onto the apparatus main body A.

Further, at the loading time of the process cartridge B, the guide pin 23 provided adjacent to the storage means 20 of the process cartridge 20 is guided by a pair of guide ribs 36 of the guide portion 32*c* so as to be finally positioned. At this time, since the contact holder 33 is movable together with the rotary arm 32 in a longitudinal direction (the direction shown by the arrow mark c) along the axial member 18*a*, the contact holder 33 moves by following the process cartridge B. For this reason, even with respect to the longitudinal direction (the direction shown by the arrow mark c), the electrical contact portions 34*a*, 34*b* and the storage means contact portions 21*a*, 21*b* can be precisely positioned.

As described above, according to the present embodiment, in a state where the cartridge cover 14 is opened and the process cartridge B is not attached onto the apparatus main body A similarly as when the process cartridge B is removed, the electrical contact portions 34*a*, 34*b* of the electrical connecting means 31 of the apparatus main body side are in a state of shunting upward of the frame portion 17 of the apparatus main body A, and therefore are not touchable to the user. For this reason, the operability at the time when the user has access to the interior of the apparatus main body A because of a jam process and the like can be enhanced and, at the same time, no trouble is caused to the electrical contact portions 34*a*, 34*b* due to the static electricity carried by the user. Further, the electrical contact portions 34*a*, 34*b* can be prevented from becoming deformed and the like due to the jam process and the like.

Further, when the process cartridge B is attached onto the apparatus main body A and the apparatus main body is applied to drive the process cartidge so that the process cartridge B (the cartridge frame body 12) moves, the contact holder 33 moves by following both the rotational direction and the longitudinal direction of the cartridge frame body 12. Hence, regardless of the apparatus main body being applied to drive or not drive the process cartridge, stable contact pressure and positional accuracy can be always obtained. Further, since the contact holder 33 and the cartridge frame body 12 directly abut against each other, it is possible to obtain precise positional accuracy of the electrical contact portions 34*a*, 34*b* and the storage means contact portions 21*a*, 21*b*.

By constituting the electrical connecting means of the apparatus main body A as described above, electrical connection between the storage means 20 of the process cartridge B and the apparatus main body A can be stabilized.

Second Embodiment

Next, a second embodiment of the image forming apparatus of the present invention will be described by using FIG. 8 and FIG. 9. The present embodiment is different from the first embodiment in the constitution of the electrical connecting means of the apparatus main body side which is electrically connected with the storage means. Here, only the points that are different from the first embodiment, will be described, and the other points will be omitted. Note that the description will be provided by giving the same reference symbols to the same members as those of the first embodiment.

Figure 8:
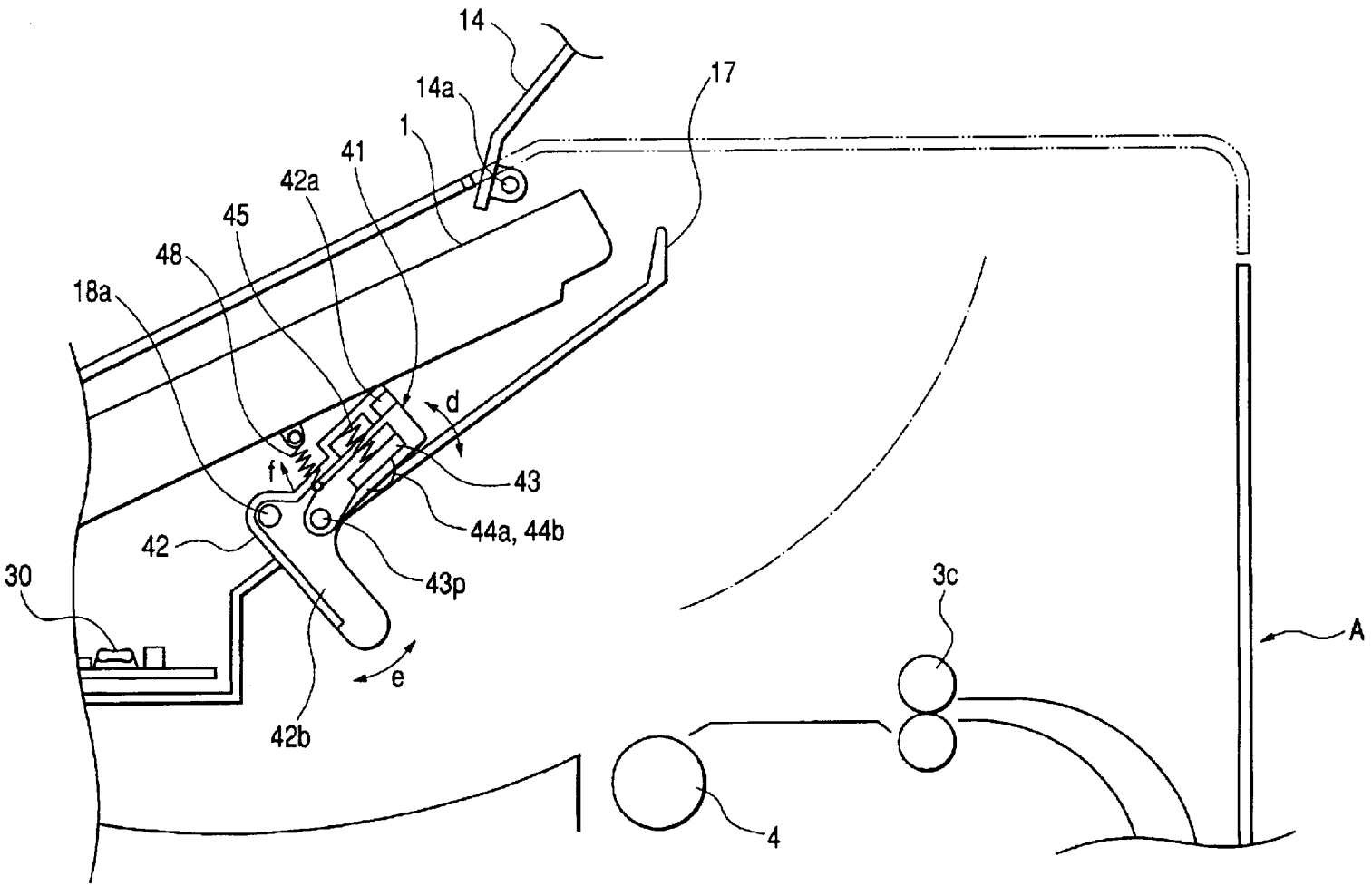
FIG. 8 is a block diagram showing a second embodiment of the image forming apparatus of the present invention, and shows the state of the process cartridge being not loaded.
Figure 9:
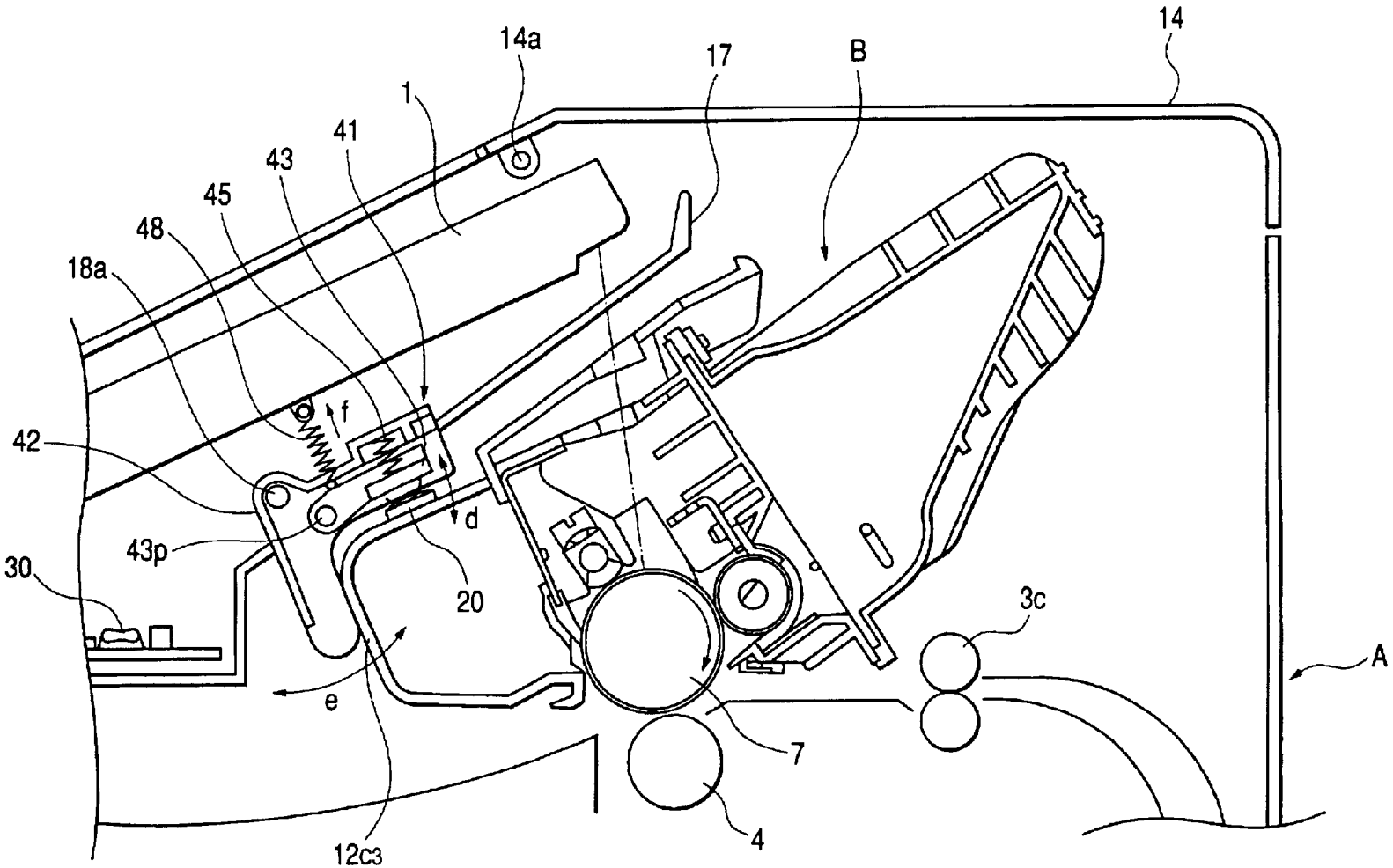
FIG. 9 is a block diagram showing the second embodiment of the image forming apparatus of the present invention, and shows the state of the process cartridge being loaded.

Electrical connecting means 41 in the present embodiment, as shown in FIG. 8 and FIG. 9, is constituted by a rotary arm 42 which is a first movable member formed almost in the shape of L character and a contact holder 43 which is a second movable member. This electrical connecting means 41 is arranged at a position opposing to the storage means 20 when the process cartridge B is loaded on the apparatus main body A (see FIG. 9).

The rotary arm 42 is formed almost in the shape of L character by a main body portion 42*a* which oscillationally holds the contact holder 43 and a downward protruding portion 42*b*, which protrudes downward and is arranged so as to abut against a top end portion of the cartridge frame body 12 at the loading time of the process cartridge B. Further, on the lateral side of the main body portion 42*a* of the rotary arm 42, though not shown, similarly as the first embodiment, is integrally provided a guide portion, on whose under surface side is formed a pair of guide ribs for guiding and fitting the guide pin 23. The rotary arm 42 in its L character shaped bent portion is rotatably and slidably supported in an axial direction (thrust direction) by an axial member 18*a* which is axially supported by a bearing member 18 provided on a frame portion 17 of the apparatus main body A.

Further, the contact holder 43 is rotatably mounted in a direction shown by the arrow mark d with a rotational axis 43*p* as a center for the almost L-shaped rotary arm 42, and is biased in a clockwise direction in FIG. 8 by a spring 45 arranged between the rotary arm 42 and the contact holder 43. In the under surface of the contact holder 43 is built-in and formed electrical contact portions 44*a*, 44*b* by a press fit, which are treated with gold plating on the plate spring member of phosphor bronze, and which are connected with a control substrate 30 via a lead wire (not shown). Further, in the external side portion of the electrical contact portions 44*a*, 44*b* is formed a convex portion (not shown) similarly as the first embodiment. Accordingly, when the contact holder 43 contacts the storage means 20, the electrical contact portions 44*a*, 44*b* are brought into contact with storage means contact portions 21*a*, 21*b*, and the convex portion (not shown) is constituted so as to abut against the upper surface portion of the cartridge frame body 12 (the cleaning frame body 12*c*).

As described above, in the bent portion of the almost L-shaped rotary arm 42, the electrical connecting means 41 is arranged rotatably and slidably in an axial direction (thrust direction) by an axial member 18*a* which is axially supported by a bearing member 18 of a frame portion 17 of the apparatus main body. Further, the rotary arm 42 is biased in a counterclockwise direction around the axial member 18*a* by a spring 48 (see FIG. 8 and FIG. 9) arranged between the apparatus main body and the rotary arm 42.

Next, the connecting constitution between the electrical connecting means 41 of the apparatus main body side A and the storage means 20 will be described.

When the process cartridge B is not attached onto the apparatus main body A, as shown in FIG. 8, the rotary arm 42 of the electrical connecting means 41 is at a standstill at a position biased conterclockwise with the axial member 18*a* as a center. In this way, the contact holder 43 and electrical contact portions 44*a*, 44*b* held by the main body portion 42*a* of the rotary arm 42 are held in a shunting state upward of the frame portion 17.

When the process cartridge B is being attached, a top end portion 12*c*3, which is a cartridge pushing portion of the cleaning frame body 12*c* of the process cartridge B, abuts against a downward protruding portion 42*b* of the rotary arm 42. The downward protruding portion 42*b* is pushed clockwise corresponding to further insertion of the process cartridge B, so that the rotary arm 42 of the electrical connecting means 41 rotates clockwise by opposing to a biasing force of the spring 48. When the process cartridge B is loaded on a predetermined loading region, the rotary arm 42 of the electrical connecting means 41 comes to a standstill at a position shown in FIG. 9. At the rotational time of the rotary arm 42 of the electrical connecting means 41, the contact holder 43 held by the main body portion 42*a* of the rotary arm 42 moves clockwise at the same time. The electrical contact portions 44*a*, 44*b* comprising the spring member of the contact holder 43 are brought into contact with the storage means contact portions 21*a*, 21*b* of the process cartridge B and, at the same time, the convex portions (not shown) formed on the contact holder 43 abut against the upper surface portion of the cleaning frame body 12*c* similarly as the above-described embodiment. Here, a spring force of the spring 45, which biases the contact holder 43 in a protruding direction of an arrow mark d direction, is largely set to be equal to the sum of the spring forces of the electrical contact portions 44*a*, 44*b*. Hence, the convex portions of the contact holder 43 abut against the cleaning frame body 12*c* by the spring force of the spring 45. In this way, since the convex portions of the contact holder 43 directly abut against the cleaning frame body 12*c*, there is little positional shift due to a common difference of parts, and it is possible to obtain precise positional accuracy of the electrical contact portions 44*a*, 44*b* and the storage means contacts 21*a*, 21*b*. Note that the timing for the electrical contact portions 44*a*, 44*b* to contact the storage means contact portions 21*a*, 21*b* may occur either during the time when the process cartridge B is attached onto the apparatus main body A or after the process cartridge B is loaded on the apparatus main body A.

Further, even with respect to the longitudinal position of the electrical connecting means at the loading time of the process cartridge B, similar to the first embodiment, the electrical connecting means moves by following the process cartridge B and can be precisely positioned.

As described above, in the present embodiment also, in a state where the cartridge cover 14 is opened and the process cartridge B is not attached onto the apparatus main body A similar to when the process cartridge B is removed, the electrical contact portions 44*a*, 44*b* of the apparatus main body side are in a state of shunting upward of the frame portion 17 of the apparatus main body A, and therefore are not touchable to the user. For this reason, operability at the time when the user has access to the interior of the apparatus main body A because of a jam process and the like can be enhanced and, at the same time, no trouble is caused to the electrical contact portions 44*a*, 44*b* due to the static electricity carried by the user.

Further, when the process cartridge B is loaded on the apparatus main body A and the apparatus main body is applied to drive the process cartridge so that the process cartridge B (the cartridge frame body 12) moves, the contact holder 43 moves by following both the rotational direction and the longitudinal direction of the cartridge frame body 12. Hence, regardless of the apparatus main body being applied to drive or not drive the process cartridge, stable contact pressure and positional accuracy can be always obtained. Further, since the contact holder 43 and the cartridge frame body 12*c* directly abut against each other, it is possible to obtain precise positional accuracy of the electrical contact portions 44*a*, 44*b* and the storage means contacts 21*a*, 21*b*.

By constituting the electrical connecting means of the process cartridge and the apparatus main body as described above, electrical connection between the storage means 20 and the apparatus main body can be stabilized.

Third Embodiment

Next, a third embodiment of the image forming apparatus of the present invention will be described by using FIG. 10 and FIG. 11. The present embodiment is different from the first and the second embodiments in the constitution of electrical connecting means of the apparatus main body to be electrically connected with storage means. Here, only the points that are different from the first and the second embodiments, will be described, and the other points will be omitted. Note that the description will be provided by giving the same reference symbols to the same members as those of the first and the second embodiments.

Figure 10:
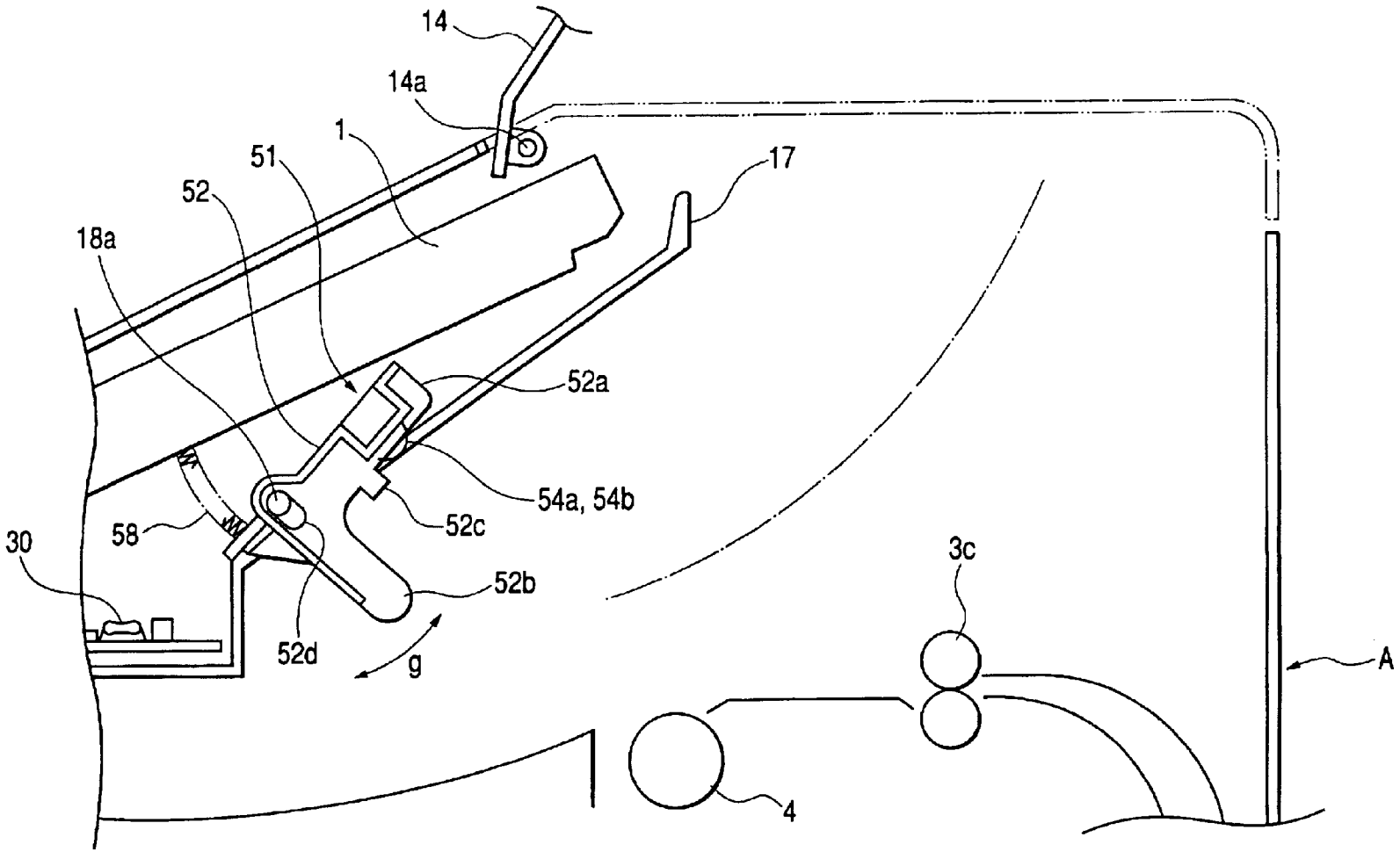
FIG. 10 is a block diagram showing a third embodiment of the image forming apparatus of the present invention, and shows the state of the process cartridge being not loaded.
Figure 11:
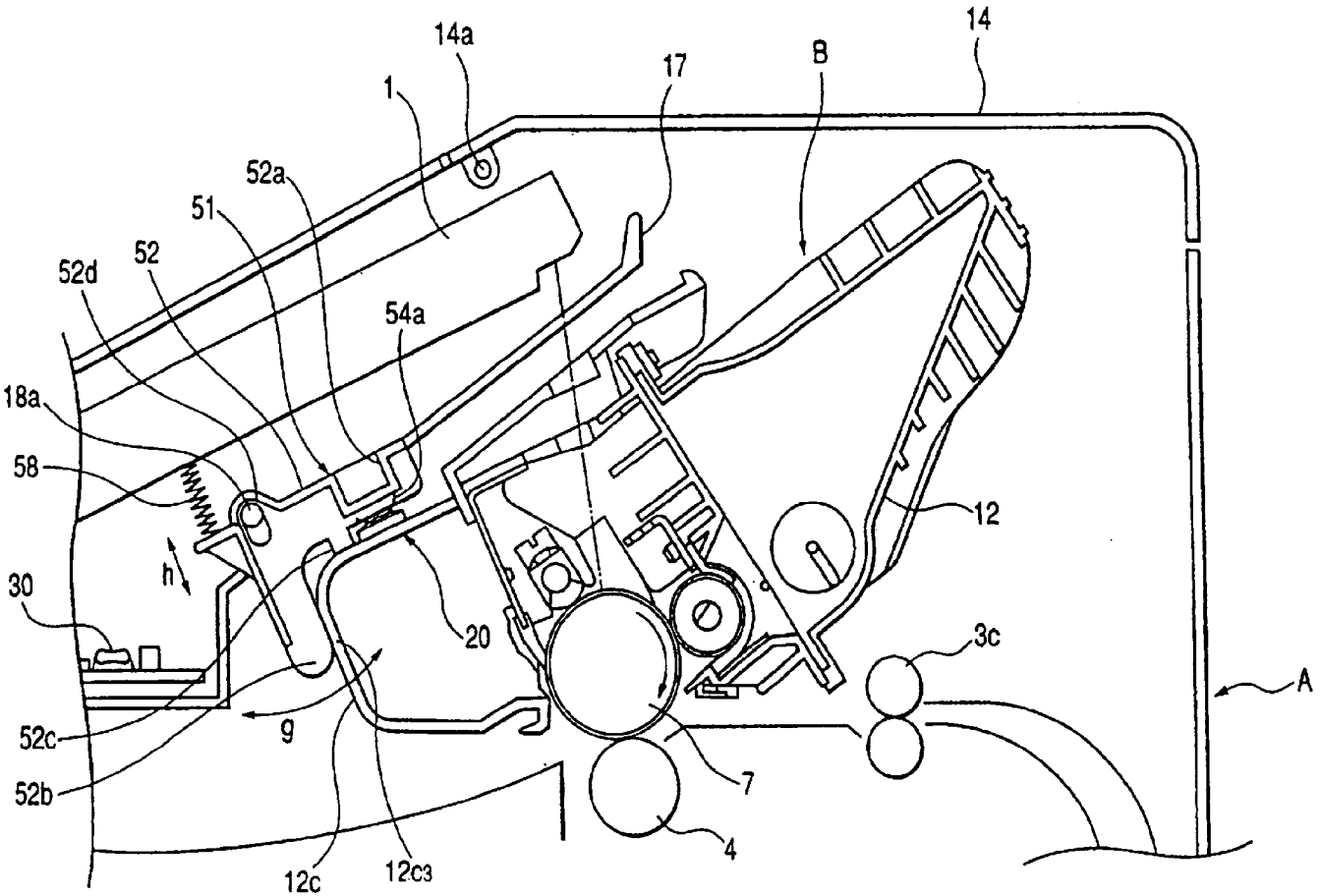
FIG. 11 is a block diagram showing the third embodiment of the image forming apparatus of the present invention, and shows the state of the process cartridge being loaded.

Electrical connecting means 51 in the present embodiment, as shown in FIG. 10 and FIG. 11, is arranged at a position opposing to the storage means 20 when a process cartridge B is attached onto an apparatus main body A. This electrical connection means 51 has an almost L-shaped rotary arm 52, and this rotary arm 52 is formed by a main body portion 52*a*, into which electrical contact portions 54*a*, 54*b* treated with gold plating on a phosphor bronze spring material is built, and a downward protruding portion 52*b*, which protrudes downward and is arranged so as to abut against a top end portion 12*c*3, which is a cartridge pushing member of a cartridge frame body 12 at the loading time of the process cartridge B. Further, in the under surface of the main body portion 52*a* of the rotary arm 52 is formed a convex portion 52*c* which abuts against the upper surface of the cleaning frame body 12*c*. Further, on the lateral side of the main body portion 52*a* of the rotary arm 52, though not shown, similarly as the first embodiment, is integrally provided a guide portion on whose under surface side is formed a pair of guide ribs for guiding and fitting the guide pin 23.

The rotary arm 52 has a long hole 52*d* formed in its L-shaped bent portion, and is supported by an axial member 18*a*, which is axially supported by a bearing member 18 provided on a frame portion 17 of the apparatus main body, and is slidably movable in a direction shown by an arrow mark h and rotatable in a direction shown by an arrow mark g. Further, the rotary arm 52 is based in a counterclockwise direction around the axial member 18*a* by a spring 58 arranged between the apparatus main body A and the rotary arm 52. Accordingly, when the process cartridge is not attached onto the apparatus main body A, as shown in FIG. 10, the rotary arm 52 is biased in a counterclockwise direction in a state where an upper end of the long hole 52*d* contacts the axial member 18*a*, and comes to a standstill at a position shown in FIG. 10. In this way, the electrical contact portions 54*a*, 54*b* are placed at a position shutting upward of the frame portion 17 of the apparatus main body.

Here, when the process cartridge B is attached, the top end portion of the cleaning frame body 12*c* of the process cartridge B abuts against the downward protruding portion 52*b* of the rotary arm 52. The downward protruding portion 52*b* is pushed clockwise corresponding to further insertion of the process cartridge B, so that the rotary arm 52 of the electrical connecting means 51 rotates clockwise by opposing an energizing force of the spring 58. For this reason, when the process cartridge B is attached onto a predetermined cartridge loading region, the rotary arm 52 comes to a standstill at a position as shown in FIG. 11. Further, the convex portion 52*c* formed on the under surface of the rotary arm 52 abuts against the upper surface portion of the cleaning frame body 12*c*, so that, with respect to a position in a rotary direction, the rotary arm 52 is positioned in a position shown in FIG. 11 and comes to a standstill. In this way, similarly as the first and the second embodiments, the positioning between the electrical contact portions 54*a*, 54*b* and storage means contacts 21*a*, 21*b* can be precisely performed.

Here, the spring force of the spring 58 is largely set to be equal to the sum of the spring forces of the electrical contact portions 54*a*, 54*b*. Hence, the convex portion 52*c* of the rotary arm 52 abuts against the cleaning frame body 12*c* by the spring force of the spring 58. Here, since the rotary arm 52 and the cleaning frame body 12*c* directly abut against each other, there is little positional shift due to a common difference of parts, and it is possible to obtain precise positional accuracy of the electrical contact portions 54*a*, 54*b* and the storage means contacts 21*a*, 21*b*. Note that the timing for the electrical contact portions 54*a*, 54*b* to contact the storage means contact portions 21*a*, 21*b* may either occur during the time when the process cartridge B is attached onto the apparatus main body A or after the process cartridge B is attached onto the apparatus main body A.

Further, even with respect to the longitudinal position of the electrical connecting means at the loading time of the process cartridge B, similar to the first and the second embodiments, the electrical connecting means moves by following the process cartridge B and can be precisely positioned.

As described above, even in the present embodiment, in a state where a cartridge cover 14 is opened and the process cartridge B is not attached onto the apparatus main body A similar to when the process cartridge B is removed, the electrical contact portions 54*a*, 54*b* of the apparatus main body side are in a state of shunting upward of the frame portion 17 of the apparatus main body A, and therefore are not touchable by the user. For this reason, operability at the time when the user has access to the interior of the apparatus main body A because of a jam process and the like can be enhanced and, at the same time, no trouble is caused to the electrical contact portions 54*a*, 54*b* due to the static electricity carried by the user. Further, similar to the first embodiment, the electrical contact portions 54*a*, 54*b* can be prevented from becoming deformed and the like due to the jam process and the like.

Further, when the process cartridge B is attached onto the apparatus main body A and the apparatus main body is applied to drive the process cartridge so that the process cartridge B (the cartridge frame body 12) moves, the rotary arm 52 moves by following the rotational direction and the longitudinal direction of the cartridge frame body 12. Hence, regardless of the apparatus main body being applied to drive or not drive the process cartridge, stabilized contact pressure can be always obtained. Further, since the rotary arm 52 and the cleaning frame body 12*c* directly abut against each other, it is possible to obtain precise positional accuracy of the electrical contact portions 54*a*, 54*b* and the cartridge electrical contacts 21*a*, 21*b*.

Further, in the present embodiment, since the electrical connecting means 51 is constituted solely by the rotary arm, the number of parts is few, and the cost thereof is advantageous.

By constituting the electrical connecting means of the process cartridge and the apparatus main body as described above, the electrical connection between the storage means 20 and the apparatus main body can be stabilized.

Fourth Embodiment

Next, a fourth embodiment of the image forming apparatus of the present invention will be described by using FIG. 12 to FIG. 15. The present embodiment is different from the above-described embodiments in the constitution of electrical connecting means of the apparatus main body to be electrically connected with storage means. Here, only the that are different from the above-described embodiments, will be described, and the other points will be omitted. Note that the description will be provided by giving the same reference symbols to the same members as those of the first to the third embodiments.

Figure 15:
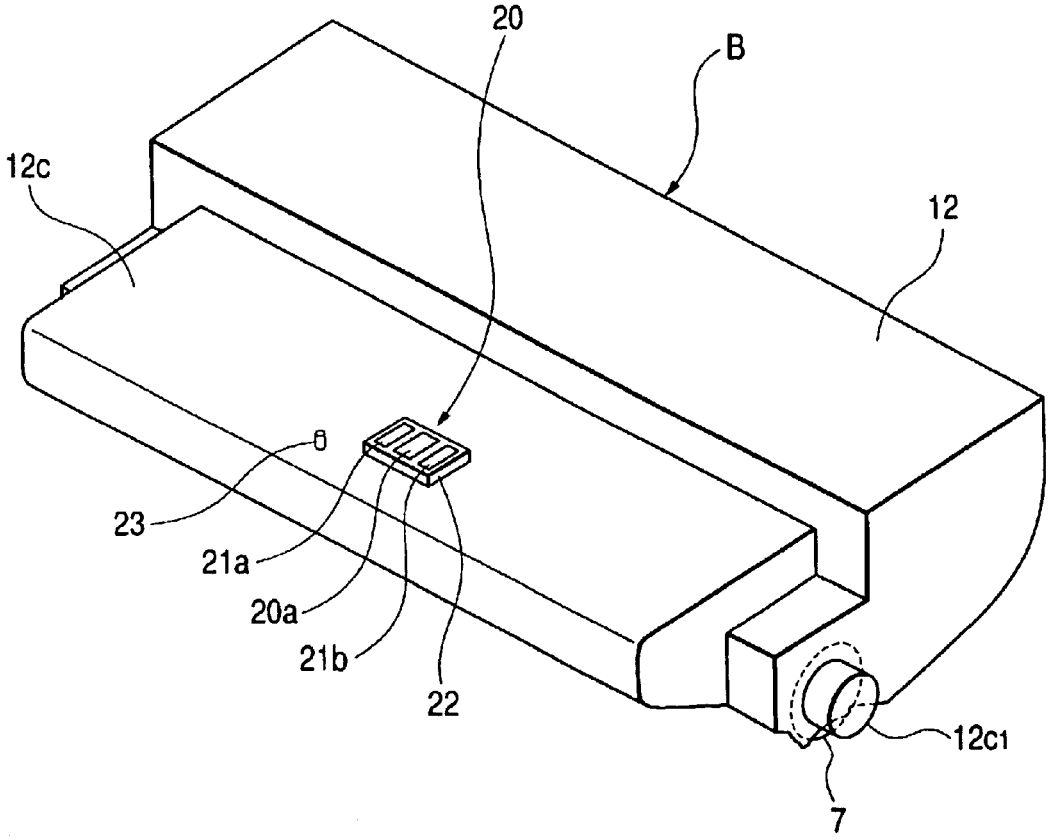
FIG. 15 is an external perspective view of the process cartridge in the fourth embodiment of the image forming apparatus of the present invention.

The process cartridge B in the present embodiment, as shown in FIG. 15, has storage means 20 mounted on the external surface of a cartridge frame body 12, particularly, on the upper surface of a cleaning frame body 12*c*. The storage means 20, similar to the above-described embodiments, has a memory chip 20*a* and contact portions

21*a*, 21*b* of both sides thereof on a substrate 22. A guide pin 23 is provided adjacent to the storage means 20. This guide pin 23 is arranged at a position to engage with a guide rib 66 of electrical connecting means 61 in order to decide a position in a thrust direction of electrical connecting means 61 of the apparatus main body side when the process cartridge B is being attached onto the main body A.

Figure 13:
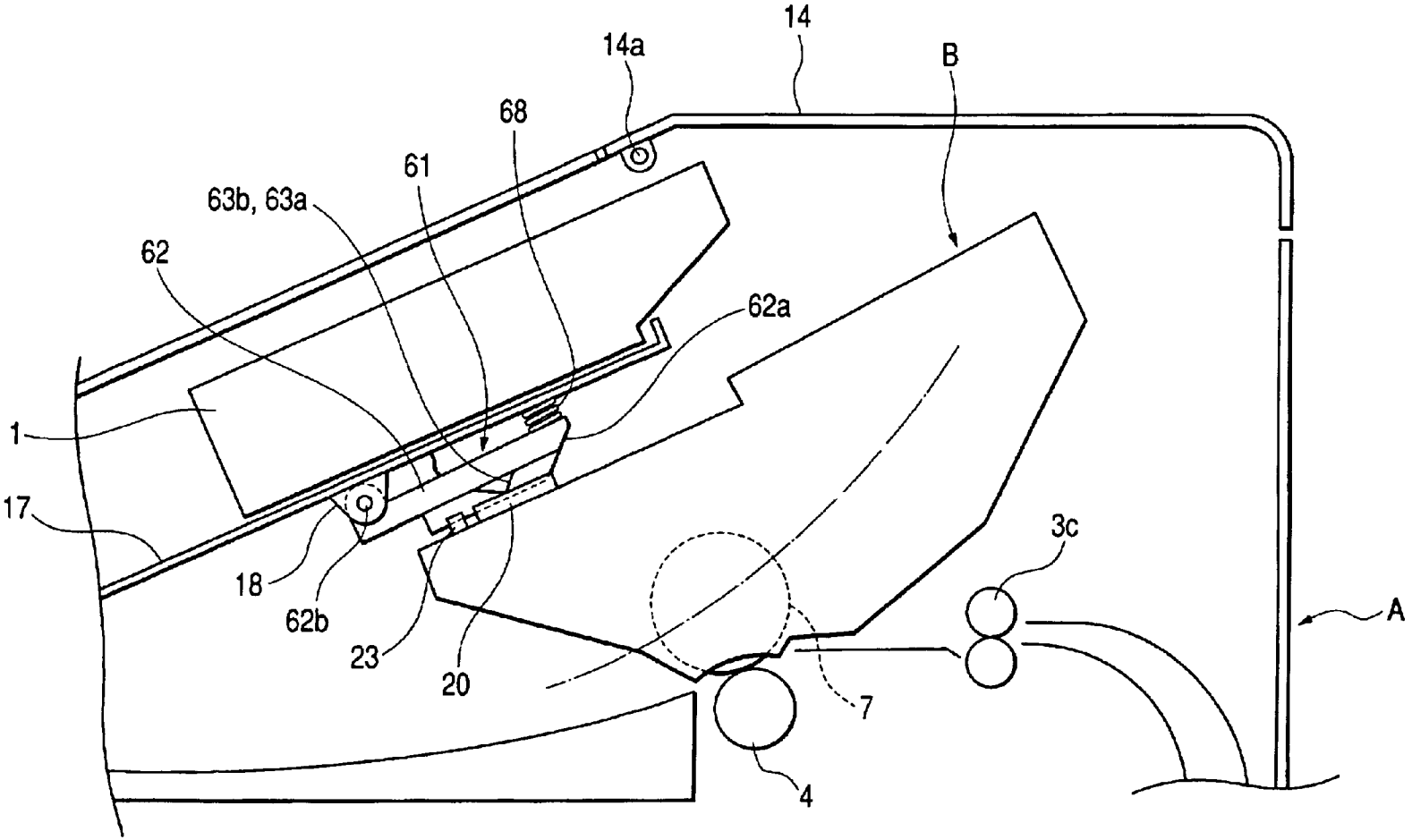
FIG. 13 is a block diagram showing the fourth embodiment of the image forming apparatus of the present invention, and shows the state of the process cartridge being loaded.
Figure 14:
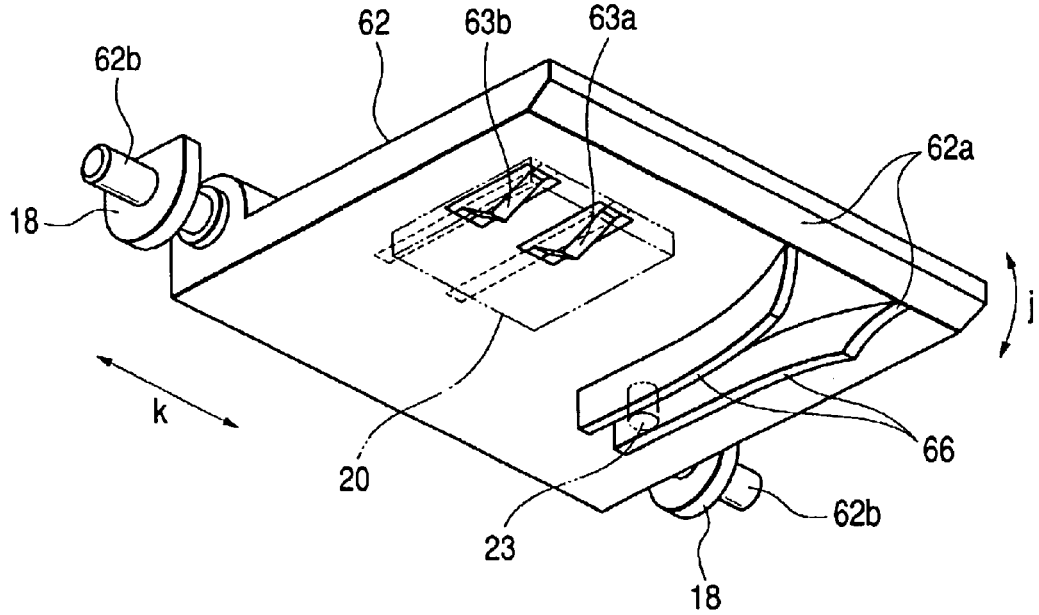
FIG. 14 is a perspective view showing the electrical connecting means in the fourth embodiment of the image forming apparatus of the present invention.

Next, the constitution of the electrical connecting means provided on the apparatus main body side will be described by using FIG. 12 to FIG. 14.

Figure 12:
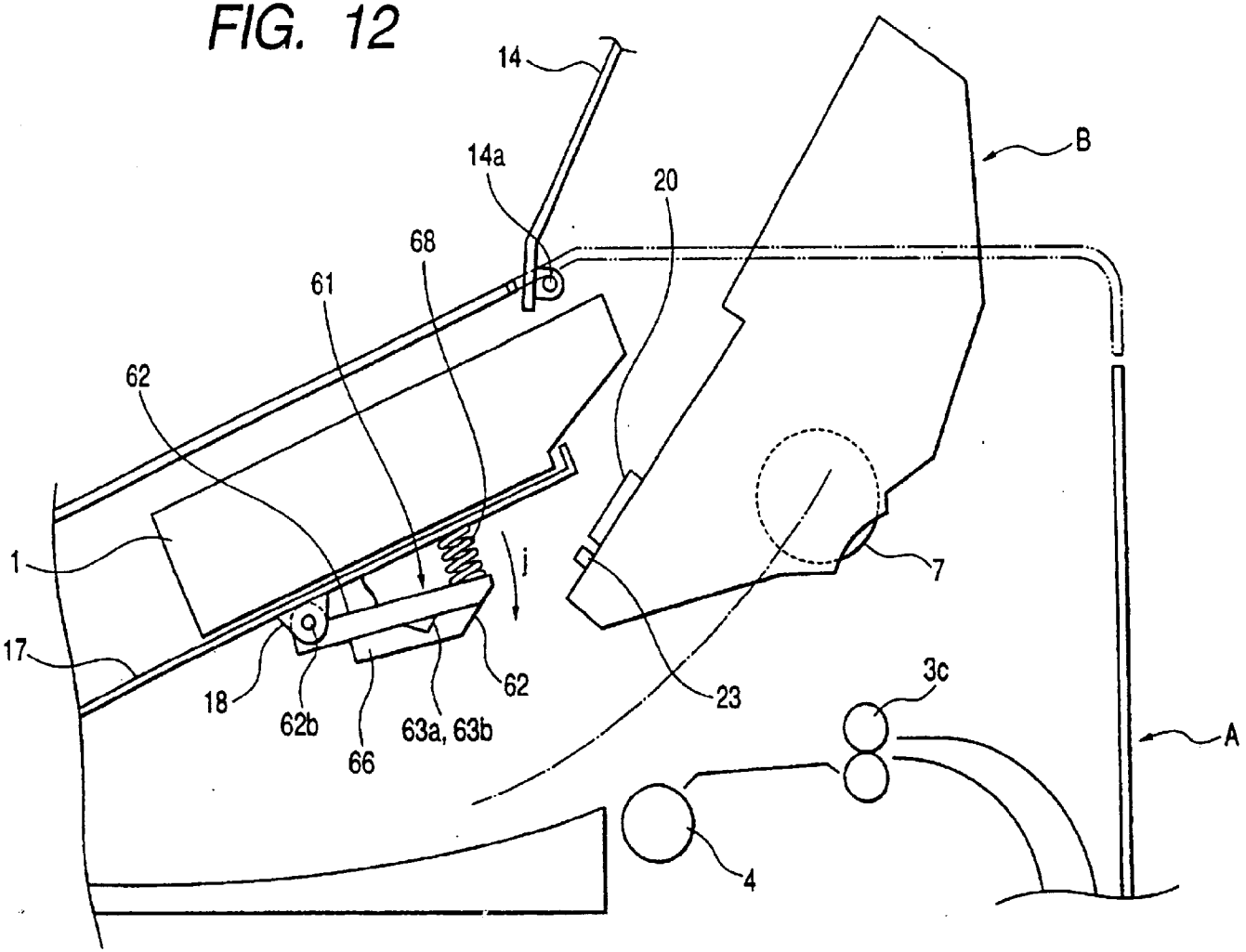
FIG. 12 is a block diagram showing a fourth embodiment of the image forming apparatus of the present invention, and shows the state of the process cartridge being not loaded.

The electrical connecting means 61 for reading and writing information for the storage means 20 arranged on the process cartridge B, as shown in FIG. 12, is arranged at a position opposing the storage means 20 when the process cartridge B is attached onto the apparatus main body A. The electrical connecting means 61, as shown in FIG. 14, includes electrical contact portions 63*a*, 63*b* consisting of a spring material for performing communication of the information by contacting storage means contact portions 21*a*, 21*b* and a contact holder 62 having at its under surface a pair of guide ribs for guiding and positioning the guide pin 23 provided on the process cartridge B. In one end at the periphery of a contact holder 62 and one end peripheral portion of a guide rib 66 is formed a taper portion 62*a* to precisely perform the loading of the process cartridge B.

Further, the contact holder 62 includes also an axial member 62*b*, which is rotatably axially supported in a direction shown by an arrow mark j by the bearing member 18 provided on a frame portion 17 of the apparatus main body A. This axial member 62*b* is further removable in the thrust direction shown by an arrow mark k for the bearing member 18, and has a length longer than a back-lash in the thrust direction at the time when the process cartridge B was loaded on the apparatus main body. The axial member 62*b* never comes off from the bearing member 18 by movement toward the thrust direction.

Between the contact holder 62 and the frame portion 17 is arranged a compression spring 68, and the contact holder 62 is biased in a direction (clockwise with the axial member 62*b* as a center) to separate from the frame portion 17. At this time, a rotation stopping portion (not shown) of the contact holder 62 and the frame portion abut against each other, so that the contact holder is not allowed to rotate more than to a certain position.

Next, the connecting constitution between the storage means 20 at the loading time of the process cartridge and the electrical connecting means 61 of the apparatus main body will be described.

The contact holder 62 of the electrical connecting means 61 is in a state as shown in FIG. 12 when the process cartridge B is not loaded. When the process cartridge B is loaded from this state, a top end portion of the cartridge frame body 12 of the process cartridge B abuts against the taper portion 62*a* of the contact holder 62, so that the contact holder 62 rotates counterclockwise by opposing the spring force of the compression spring 68 with the axial member 62*b* as a center. Thereafter, as shown in FIG. 13, electrical contact portions 63*a*, 63*b* comprising a spring material of the contact holder 62 are positioned so as to abut against the storage means contact portions 21*a*, 21*b* with adequate contact pressure. At this time, the guide pin 23 of the cartridge frame body 12, as shown in FIG. 14, is positioned at grooves of a pair of guide ribs 66.

When the apparatus main body A is applied to drive the process cartridge in this state and the process cartridge B moves in the thrust direction, the guide pin 23 of the cartridge frame body 12 and the pair of guide ribs 66 fit to one another in the thrust direction. Hence, accompanied by movement of the cartridge frame body 12, the axial member 62*b* of the contact holder 62 slides against the bearing portion 18, and the contact holder 62 moves in the thrust direction, so that the storage means contact portions 21*a*, 21*b* and the electrical contact portions 63*a*, 63*b* integrally move in the thrust direction. In this way, the storage means contact portions 21*a*, 21*b* and the electrical contact portions 63*a*, 63*b* are never rubbed together in the thrust direction.

Further, when a driving force is applied to the apparatus main body A, the process cartridge B makes a thrust movement in a direction opposite to the above direction. However, even in this case, similar to what is described above, the storage means contact portions 21*a*, 21*b* and the electrical contact portions 63*a*, 63*b* integrally move together.

As described above, when the process cartridge B having the storage means 20 and the guide pin 23 is loaded on the apparatus main body A, the contact holder 62 having the pair of guide ribs 66 positioned in the thrust direction for the process cartridge B is loaded on the apparatus main body A. Hence, simultaneously with movement in the thrust direction of the process cartridge B, the contact holder 62 also integrally moves, so that the electrical connection can be stabilized without causing cutting and deformation of the storage means 20 and the electrical contact portions 63*a*, 63*b*.

Fifth Embodiment

Next, a fifth embodiment of the image forming apparatus of the present invention will be described by using FIG. 16 to FIG. 19. The present embodiment is different from the above-described embodiments in the constitution of electrical connecting means of the apparatus main body side to be electrically connected with storage means of a process cartridge. Here, only points, which are different from the above-described embodiments will be described, and other points will be omitted. Note that the description will be provided by giving the same reference symbols to the same members as those of the first to the fourth embodiments.

Figure 19:
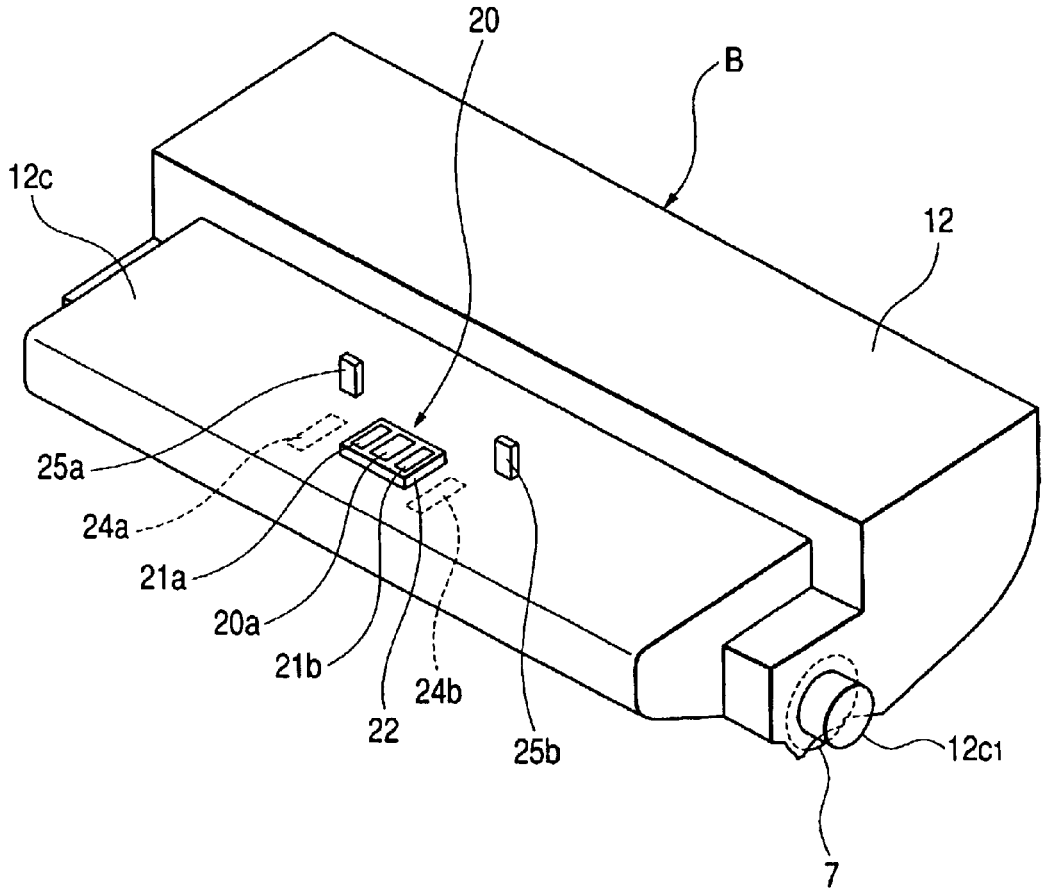
FIG. 19 is an external perspective view of the process cartridge in the fifth embodiment of the image forming apparatus of the present invention.

A process cartridge B in the present embodiment, as shown in FIG. 19, has storage means 20 mounted on the external surface of a cartridge frame body 12, particularly, on the upper surface of a cleaning frame body 12*c*. The storage means 20, similar to the above-described embodiments, has a memory chip 20*a* and contact portions 21*a*, 21*b* of both sides thereof on a substrate 22. Metal plates 24*a*, 24*b* for mounting magnets on symmetrical positions are provided adjacent to the storage means 20. Although these metal plates 24*a*, 24*b* may be kept uncovered in the metal surfaces, the plates may be covered by other members to such a degree to mount the magnets. Further, when the process cartridge B is loaded on the apparatus main body, two pieces of pushing ribs 25*a*, 25*b* for pushing out the magnets by abutting against the electrical connecting means are formed.

Next, the constitution of the electrical connecting means provided on the apparatus main body will be described by using FIG. 16 to FIG. 18.

Figure 18A:
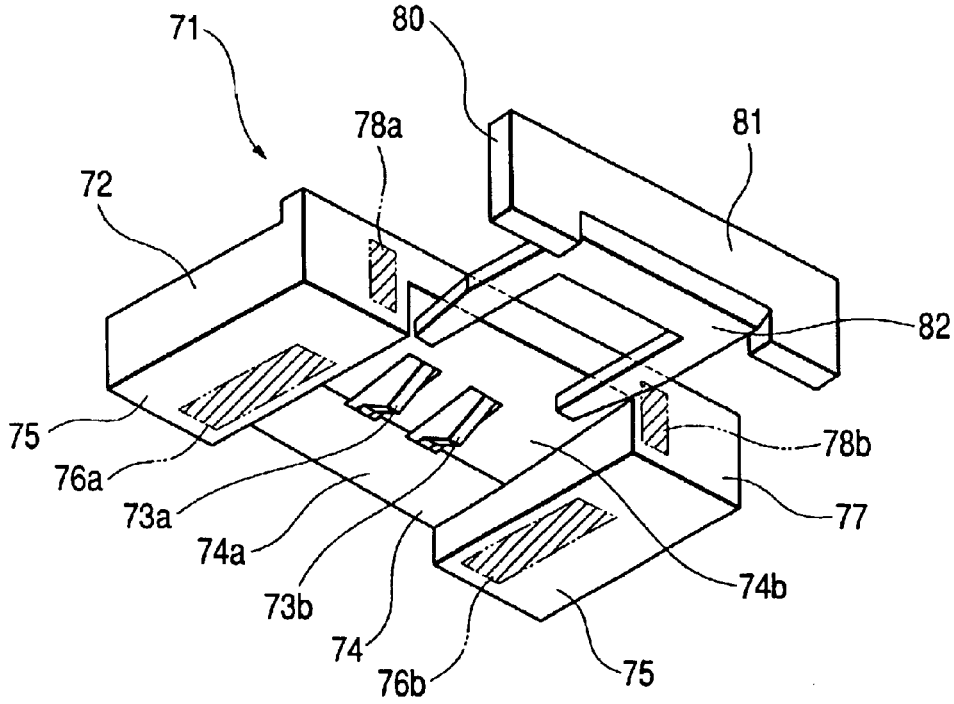
FIGS. 18A and 18B are views showing the electrical connecting means in the fifth embodiment of the image forming apparatus of the present invention.
Figure 18B:
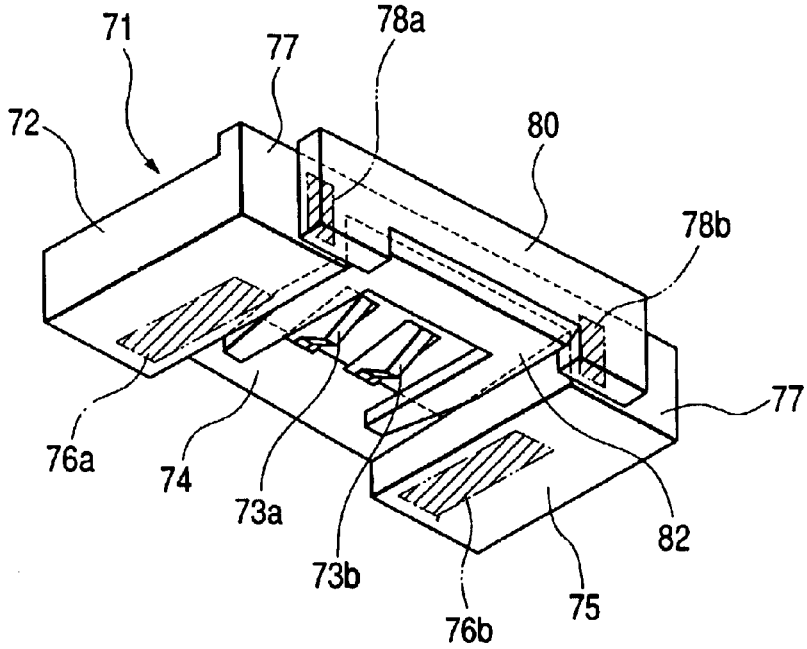

Electrical connecting means 71 in the present embodiment, as shown in FIG. 18A and FIG. 18B, is constituted by a contact holder 72 which is adjacent to the storage means contact portions 21*a*, 21*b* and forms electrical contact portions 73*a*, 73*b* comprising a spring material for performing communication of the information and a holder holding member 80, which abuts against the contact holder 72 and holds it separable.

In the contact holder 72 is formed a central concave portion 74, which is constituted by a surface 74*a* parallel to the under surface at the under surface central portion and a taper surface 74*b* sloping upward to the side to which the process cartridge B is loaded. In this taper surface 74*b* is arranged electrical contact portions 73*a*, 73*b* comprising a pair of springs. The under surfaces positioned at both sides of the central concave portion 74 are flat contact surfaces 75 formed so as to abut against the upper surface of a cartridge frame body 12 (12*c*) of the process cartridge B. In the contact surfaces 75, built-in magnets 76*a*, 76*b* at the positions corresponding to metal plates 24*a*, 24*b* are arranged on the upper surface of the cartridge frame body 12 (12*c*). Further, the surface at the side where the process cartridge B comes to be loaded in the surface orthogonal to the flat contact surface 75 is taken as a holder pushing surface 77, and in a holder pushing surface 77 is built-in magnets 78*a*, 78*b* for absorbing a holder holding member 80. From the contact holder 72 a lead wire 79(see FIG. 16 and FIG. 17) to perform an electrical communication with a control portion (not shown) of the apparatus main body is connected.

On the other hand, the holder holding member 80 for separably holding the contact holder 72 is constituted by an abutted surface 81 to be absorbed by the magnets 78*a*, 78*b* of the holder pushing surface 77 by opposing to the holder pushing surface 77 of the contact holder 72 and an U-shaped support portion 82 which is inserted into the central concave portion 74 of the contact holder 72 and is formed so as to support the contact holder 72. The length in the width direction of the abutted surface 81 is narrower than the width of the contact holder 72. This holder holding member 80 may be constituted by a metal as a whole, or may be constituted by incorporating metal into a part only which abuts against the magnets 78*a*, 78*b*.

The electrical connecting means 71 constituted as described above, as shown in FIG. 16 and FIG. 17, is mounted on the frame portion 17 upward of the cartridge loading region for loading the process cartridge B. The holder holding member 80 of the electrical connecting means 71 is mounted at a region slightly biased to the side where the process cartridge B comes to be loaded in the cartridge loading region. In a state where the process cartridge B is not attached, as shown in FIG. 16 and FIG. 18B, the contact holder 72 has the U-shaped support portion 82 of the holder holding member 80 inserted into the central concave portion 74. The magnets 78*a*, 78*b* abut against the abutted surface 81, and are absorbed and held by the holder holding member 80.

Figure 16:
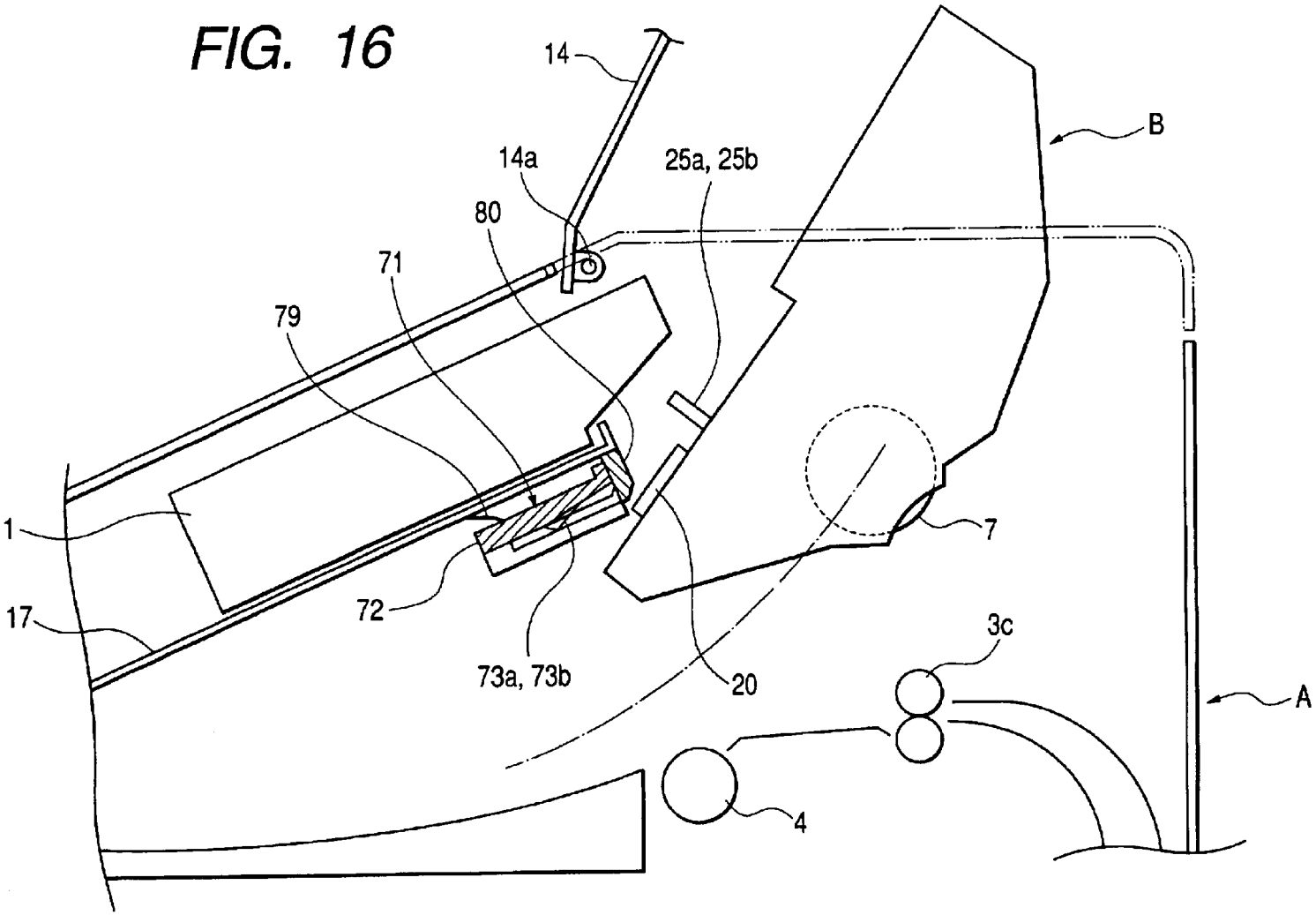
FIG. 16 is a block diagram showing a fifth embodiment of the image forming apparatus of the present invention.
Figure 17:
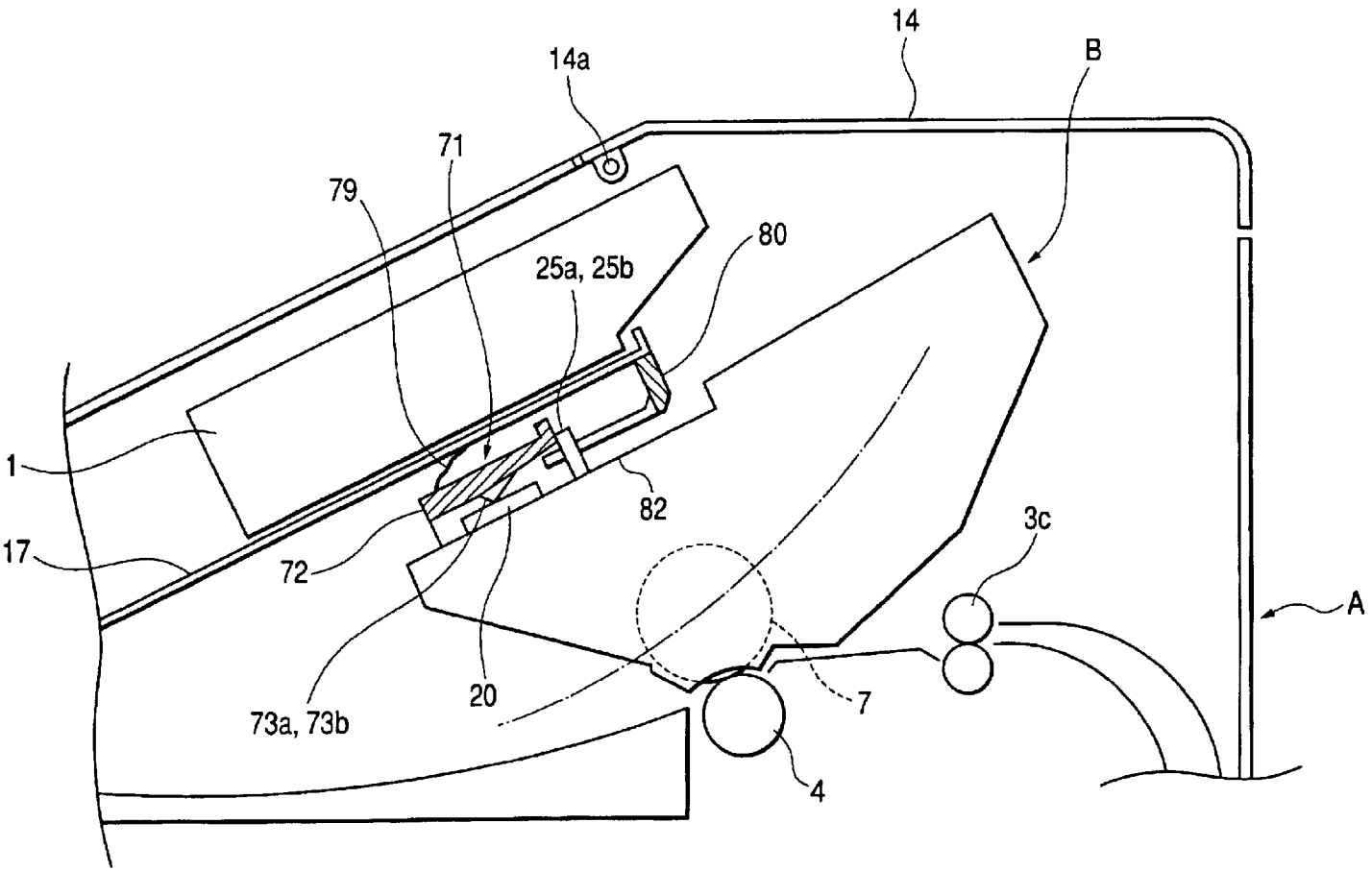
FIG. 17 is a block diagram showing a fifth embodiment of the image forming apparatus of the present invention, and shows the state of the process cartridge being loaded.

When the process cartridge is being attached onto the apparatus main body, the electrical connecting means 71 is in a state as shown in FIG. 16 and FIG. 18A, and is in an uncovered state with the pushing surface 77 of the contact holder 72 protruded from the abutted surface 81 of the holder holding member 80. When the process cartridge B is being attached in this state, pushing ribs 25*a*, 25*b* of the process cartridge B abut against both side end portions of the holder pushing surface 77 of the contact holder 72, so that the magnets 78*a*, 78*b* of the contact holder 72 are pushed so as to be separated from the abutted surface 81. At the same time, the metal plates 24*a*, 24*b* arranged on the process cartridge B come to a position opposing the contact surface 75 of the contact holder 72. Hence, the magnets 78*a*, 78*b* are separated from the abutted surface 81, and simultaneously, the magnets 78*a*, 78*b* built in the contact surface 75 absorb the metal plates 24*a*, 24*b* of the process cartridge B, and the contact holder 72 is absorbed and held on the upper surface of the process cartridge B (see FIG. 17).

At this time, the contact holder is connected with the apparatus main body by a lead wire 79 only, and can flexibly move for the apparatus main body A. In this way, the contact holder 72 is unified with the process cartridge B, and integrally moves with the movement in the thrust direction of the process cartridge B. Hence, the electrical contact portions 73*a*, 73*b* and the storage means contact portions 21*a*, 21*b* are not rubbed together, and cutting and deformation of the electrical contact portions 73*a*, 73*b* and the storage means contact portions 21*a*, 21*b* can be prevented.

Further, in the case where the process cartridge B is pulled out from the apparatus main body A, the central concave portion 74 of the contact holder 72 and the U-shaped support portion 82 of the holder holding member 80 are positioned linearly in a detachably attachable direction of the process cartridge B. Hence, accompanied by a pulling-out operation of the process cartridge B, the U-shaped support portion 82 of the holder holding member 80 comes to contact a surface 74*a* from a taper surface 74*b* of the central concave portion 74, and the contact holder 72 receives a force in a direction to be stripped from the process cartridge B. At the same time, since the contact holder 72 moves toward the abutted surface 81, the magnets 78*a*, 78*b* and the abutted surface 81 draw closer. When the process cartridge B is further pulled out from this state, as shown in FIG. 16 and FIG. 18, the magnets 78*a*, 78*b* and the abutted surface 81 are put into an attached state, and the contact holder 72 is separated from the process cartridge B so as to be held by the holder holding member 80.

In the above described embodiment, though a joining method for the contact holder 72 and the holder holding member 80 and the contact holder 72 and the process cartridge B was constituted by magnets and metals, by using flexible members and by using means such as a snap-fit mechanism and the like, the contact holder may be held.

As described above, according to the present embodiment, the electrical contact portion of the electrical connecting means of the apparatus main body side can be integrally joined with the process cartridge at the loading time of the process cartridge. Further, even when the change in the posture of the process cartridge and movement toward the thrust direction are caused due to the presence or absence of driving, the electrical connection with the storage means of the process cartridge and the electrical connecting means of the apparatus main body can be reliably and satisfactorily performed.

Sixth Embodiment

A process cartridge and an image forming apparatus detachably attachable with the process cartridge which are constituted based on an sixth embodiment of the present invention will be described. Subsequently, storage means to be mounted on the process cartridge and connecting means provided on the apparatus main body side will be described with reference to FIG. 20 to FIG. 26. In the present embodiment also, a description will be provided by taking an electrophotographic laser beam printer as an example.

Figure 20:
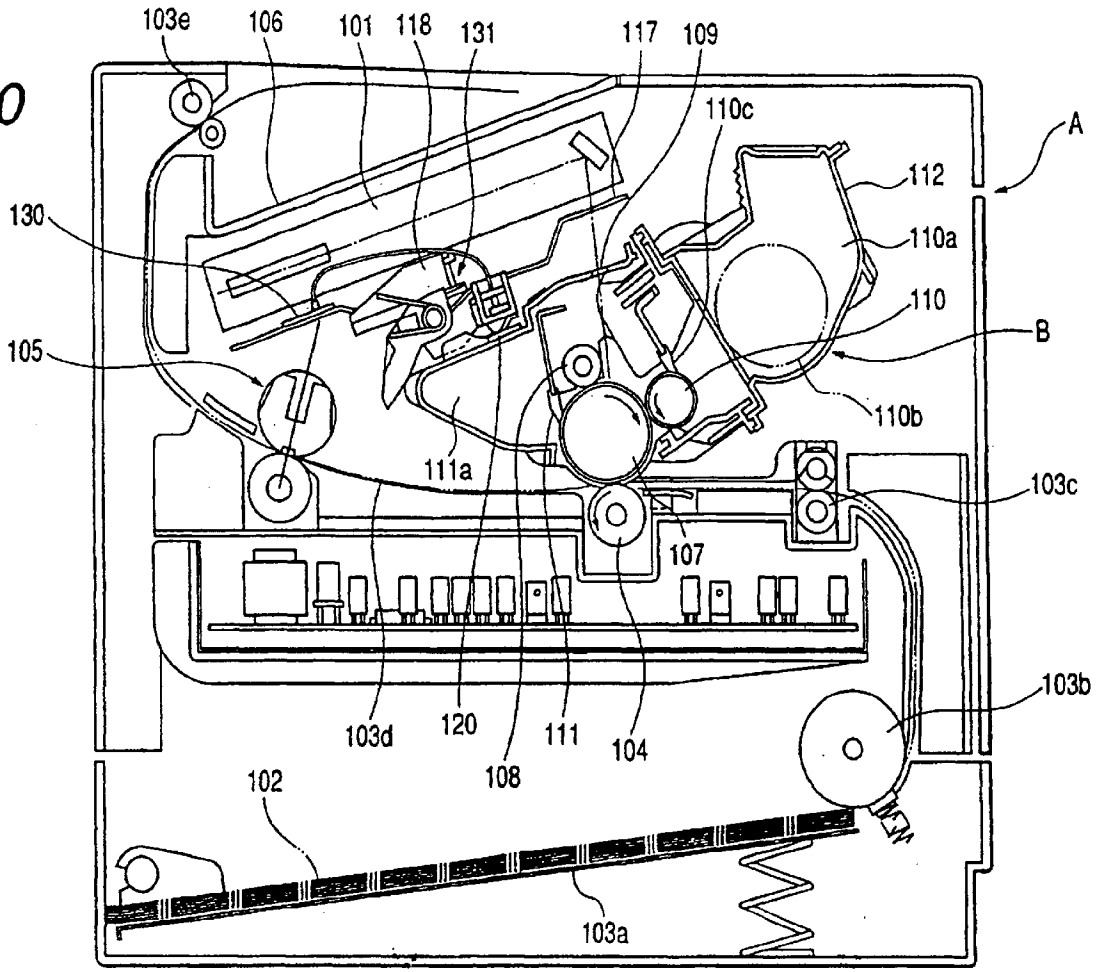
FIG. 20 is a schematic cross-sectional view showing the constitution of a sixth embodiment of the image forming apparatus of the present invention.

The image forming apparatus of the present embodiment, as shown in FIG. 20, emits a laser beam image based on image information from an optical system 101, and irradiates a photosensitive body drum 107 built inside a process cartridge B via an exposure opening 109 with the laser beam. On the photosensitive body drum 107 is formed an electrostatic latent image, and this electrostatic latent image is developed by a developer by developing means within the process cartridge B so as to form a developer image.

On the other hand, a recording medium 102 loaded on a recording medium cassette 103*a* is synchronized with formation of the developer image, and is separated and fed by a pickup roller 103*b*, and is conveyed via conveying means having a pair of conveying rollers 103*c* and the like. The recording medium 102 is transferred with the developer image formed on the photosensitive body drum 107 by a transferring roller 104. The recording medium 102 transferred with the developer image is conveyed further downstream via a guide plate 103*d*, and is conveyed to fixing means 105. The fixing means 105 fixes the developer image on the recording medium 102 by applying heat and pressure. The recording medium 102 fixed with the developer image is discharged to a discharge tray 106 outside of the apparatus by an ejection roller 103*e*.

The process cartridge B comprises the photosensitive body drum 107 and at least one process means. The process cartridge B in the present embodiment is constituted as shown in FIG. 20. The photosensitive body drum 107 having a photosensitive layer on its peripheral surface is rotated and is uniformly charged on the surface by applying a voltage to a charging roller 108, which is charging means. Subsequently, image information light from the optical system 101 is projected on the photosensitive body drum 107 via the exposure opening portion 109 provided on the process cartridge B so as to form the electrostatic latent image. The electrostatic latent image formed on this photosensitive body drum 107 is developed by using the developer by the developing means (110, 110*a*, 110*b* . . . ).

The developing means (110, 110*a*, 110*b* . . . ) delivers the developer, which is within a developer storing portion 110*a*, to a developer delivery portion 110*b*, and the developer is given to a developing roller 110 where a fixed magnet is built-in. A developer layer given with a frictional charging charge by a developer blade 110*c* is formed on the surface of the developer roller 110, and the developer is transferred on the photosensitive body drum 107 according to the latent image, so that a developer image is formed and visualized.

After the developer image has been transferred on the recording medium 102 by applying a voltage of polarity reverse to the developer image on the transferring roller 104, the developer remaining on the photosensitive body drum 107 is scraped off by a cleaning blade 111. The scraped developer is collected into a removed developer collector 111*a*.

Note that the above-described photosensitive body drum 107 and the process means (108, 110, 111 . . . ) are held within a cartridge frame body 112 which is a frame body. The cartridge frame body 112 is constituted by a developer storing frame body forming a developer storing portion 110*a* which stores the developer, a developing apparatus frame body for holding the developer 110 and the like and a cleaning frame body 112*c* (FIG. 21A and FIG. 21B) which holds the photosensitive body drum 107 and the cleaning means and forms the removed developer collector 111*a*. The developer storing frame body is unified with the developing apparatus frame body, and is joined with the cleaning frame body 112*c*, thereby constituting the process cartridge B.

Figure 21A:
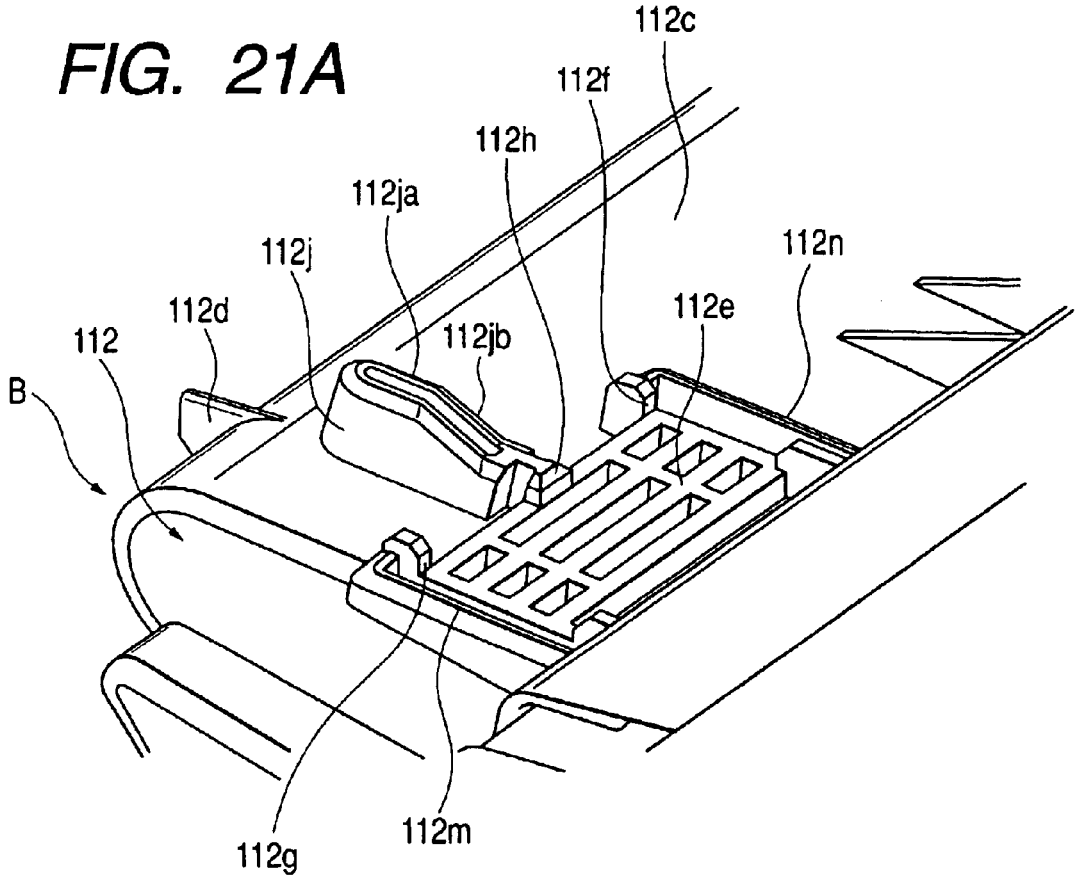
FIG. 21A is a perspective view showing the shape of a region to which storage means of the process cartridge is attached in the sixth embodiment of the image forming apparatus of the present invention.
Figure 21B:
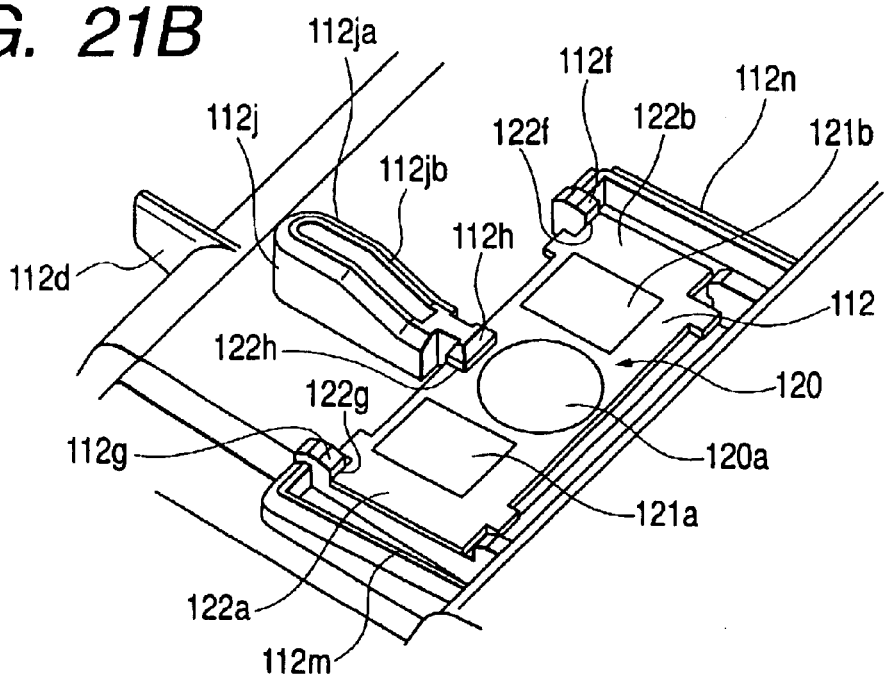
FIG. 21B is a perspective view showing the state of the storage means being mounted on the process cartridge.

Next, the constitution of the storage means (chip memory) in the present embodiment will be described by using FIG. 21. FIG. 21A is a perspective view showing a form of the region to mount the storage means in the process cartridge, and FIG. 21B is a perspective view showing a mounting state of the storage means on the process cartridge.

The storage means 120 in the present embodiment is mounted on the outside of the cartridge frame body 112 of the process cartridge B. Particularly, as shown in FIG. 20 and FIGS. 21A and 21B, the storage means 120 is mounted on the upper surface of the cleaning frame body 112*c* of the cartridge frame body 112. This storage means 120, as shown in FIG. 21B, has a memory chip 120*a* which is a memory element such as an RAM, an ROM and the like and memory element contact portions 121*a*, 121*b* of both sides thereof on a substrate 122. In this memory chip 120*a* is inputted in advance the necessary information (for example, such as a lot number of the process cartridge, the initial value and using status, such as process conditions, a characteristic of the image forming apparatus and a characteristic of the process means and the like). When the process cartridge B was loaded on the apparatus main body A, the information is exchanged with the apparatus main body side, so that the state, such as the using status and the like of the process cartridge B is communicated to a control substrate 130 (FIG. 20) of the apparatus main body A, which is useful for the image forming operation and used for the purpose of displaying to an operator of the status of the process cartridge.

The memory element contact portions 121*a*, 121*b* are electrically connected or integrally joined with the memory chip 120*a*, which is positioned in a central portion, and the memory element contact portions 121*a*, 121*b* are constituted by gold plating on its surface. In this way, even when the memory element contact portions 121*a*, 121*b* are mounted on the surface of the process cartridge B and exposed to the open air, electrical contact resistance is never increased. Further, in the external side of these memory element contact portions 121*a*, 121*b* are formed abutting portions 122*a*, 122*b*, against which abutting ribs 134*a*, 134*b* (to be described later) of electrical connecting means 131 provided on the apparatus main body abut. Further, on the substrate 122 of the storage means 120 is provided a concave portion 122*h* in the central portion at a side peripheral portion along a longitudinal direction as shown in FIG. 21B so that the positioning in a longitudinal and a transverse direction can be performed, and on both end portions of the side peripheral portion along the longitudinal direction are provided concave portion 122*f* and 122*g*.

Next, a mounting portion to mount the storage means 120 will be described. A mounting surface 112*e* of the storage means 120 of the process cartridge B, as shown in FIG. 21A, is positioned on the upper surface of the cleaning portion frame body 112*c* of the cartridge frame body 112. The concave portion 122*h* of the substrate 122 is fitted to a central positioning rib 112*h* so that positioning in a longitudinal direction for the cartridge frame body 112 of the substrate 122 is performed. Further, positioning in the transverse direction is performed by butting the butting concave portions 122*f* and 112*g* against the positioning ribs 112*f* and 112*g* of the cartridge frame body 112. That is, by the central positioning rib 112*h* and both positioning ribs 112*f* and 112*g*, a positioning member to position the storage means 120 for the frame body is constituted. The mounting surface 112*e* of the storage means 120, as shown in FIG. 21A, is constituted by a plurality of ribs so that accuracy of the mounting surface can be enhanced when preparing a mould. In this way, positioning accuracy for a vertical direction of the upper surface (a surface having a contact portion) of the storage means 120 can be enhanced.

Further, as a storage means support member, ribs 112*m* and 112*n*, which are protrusively provided at both end portions in a longitudinal direction of the mounting surface 112*e*, have their intervals set slightly wider than the longitudinal length of the storage means 120, and are constituted to be higher than the thickness of the storage means 120. In this way, a finger is not allowed to touch both end portions in a longitudinal direction of the storage means 120, so that the storage means 120 is prevented from dislocating from the mounting surface 112*e*.

Note that, in FIGS. 21A and 21B, a butting rib 112*d* is a butting member cartridge pushing portion, which is formed at a front end portion in a cartridge inserting direction of the cartridge frame body 112 at a region adjacent to the mounting surface 112*e* of the storage means 120, and abuts against electrical connecting means 131, to be described later, of the apparatus main body side so as to move main body contact portions 133*a*, 133*b*, which are main body electrical contacts toward the storage means 120. Further, reference numeral 112*j* denotes a guide rib, which extends frontward in a cartridge inserting direction from the central positioning rib 112*h*. From among upward end surfaces or upper end portions 112*ja*, 112*jb* thereof, the upward end surface 121*ja* of a front portion in an inserting direction of the cartridge has its height formed high, and the upward end surface 121*jb* following the former is formed so as to become low in height by gradually inclining to the height of the central positioning rib 112*h*. Thus, portion 112*jb* is also called an inclined portion. This guide rib 112*j*, as to be described later, has a guide portion to control the position, in a direction orthogonal to the loading direction of the process cartridge B, of the electrical connecting means 131, which is the connecting means to support the main body side contact portion. Further, the guide rib 112*j* controls the position in a height direction of the main body contact portions 133*a*, 133*b* of the electrical connecting means 131, and performs also an operation as an abutting portion to guide the main body contact portions 133*a*, 133*b* in a direction to contact the memory element contact portions 121*a*, 121*b*.

Figure 22:
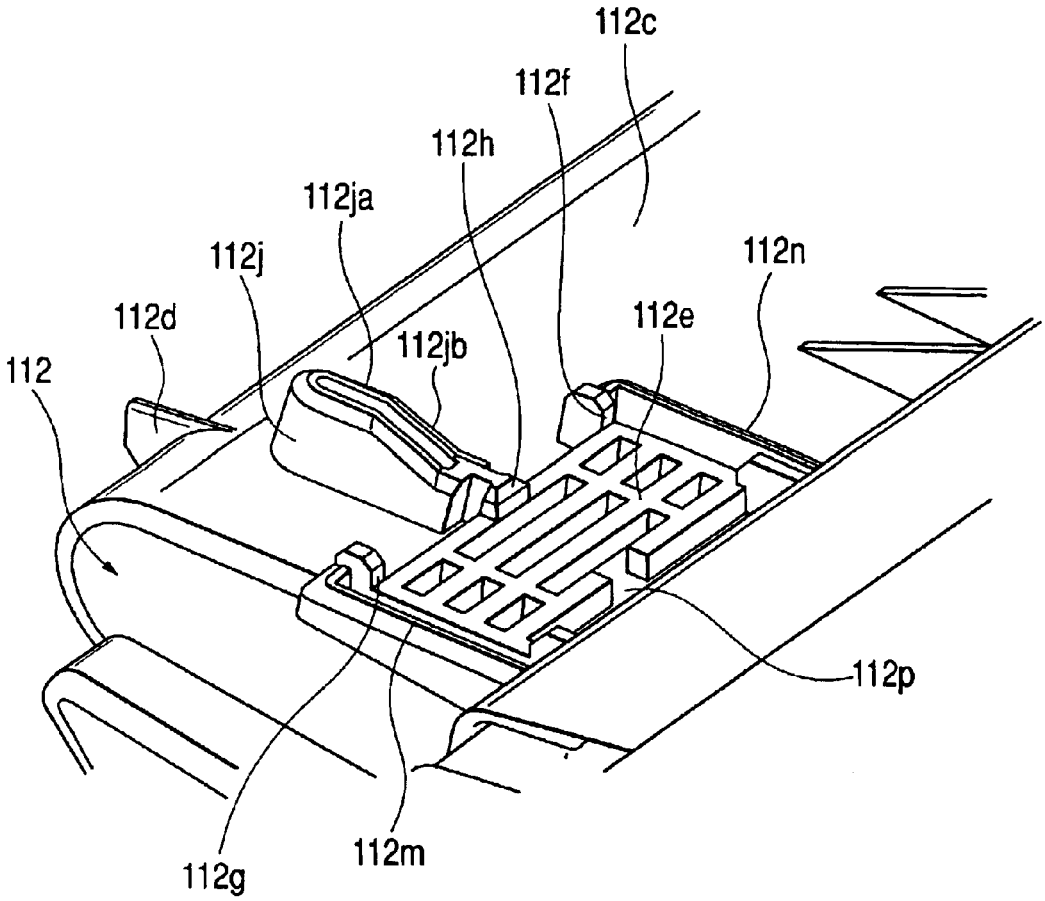
FIG. 22 is a perspective view showing the shape of another region on which the storage means of the process cartridge is mounted in the sixth embodiment of the image forming apparatus of the present invention.

The mounting of the storage means 120 on the mounting surface 112*e* can be performed by using a double-coated tape, a bonding agent, heat calking and the like. At this time, in the case where the operator touches or when the process cartridge is loaded on the apparatus main body, an adhering strength for adhering the storage means 120 on the mounting surface so that these elements are not easily dislocated by contact with the electrical connecting means 131 to be described later has to be given, and in the mounting surface 112*e* constituted by a plurality of ribs as shown in FIG. 21A, the thickness of the ribs and the number of ribs are decided so that the surface 112*e* becomes a contact area capable of having the required contact strength. Further, in a material renewal recycle process of the used process cartridge, it is necessary to take out the storage means 120 from the cartridge frame body 112. At this time, since the mounting surface 112*e* of the storage means 120 comprises a rib constitution, even if the mounting surface 112*e* is fixed by, for example, the double-coated tape and the like, the sticking force does not become abnormally high, and therefore, the used storage means 120 can be easily stripped off from the mounting surface 112*e*. As shown in FIG. 22, in a part of the rib is provided a small chip portion 112*p*. In this way, or by arranging a rib which can directly abut against a removal tool (not shown) on the reverse side of the storage means 120, there is an advantage in that a removal operation of the storage means 120 from the cartridge frame 112 of the process cartridge B becomes easy.

Next, the constitution of the electrical connecting means provided on the apparatus main body and an electrical connecting operation with the connecting means and the storage means of the process cartridge will be described by using FIG. 20 and FIG. 23 to FIG. 26.

Figure 23A:
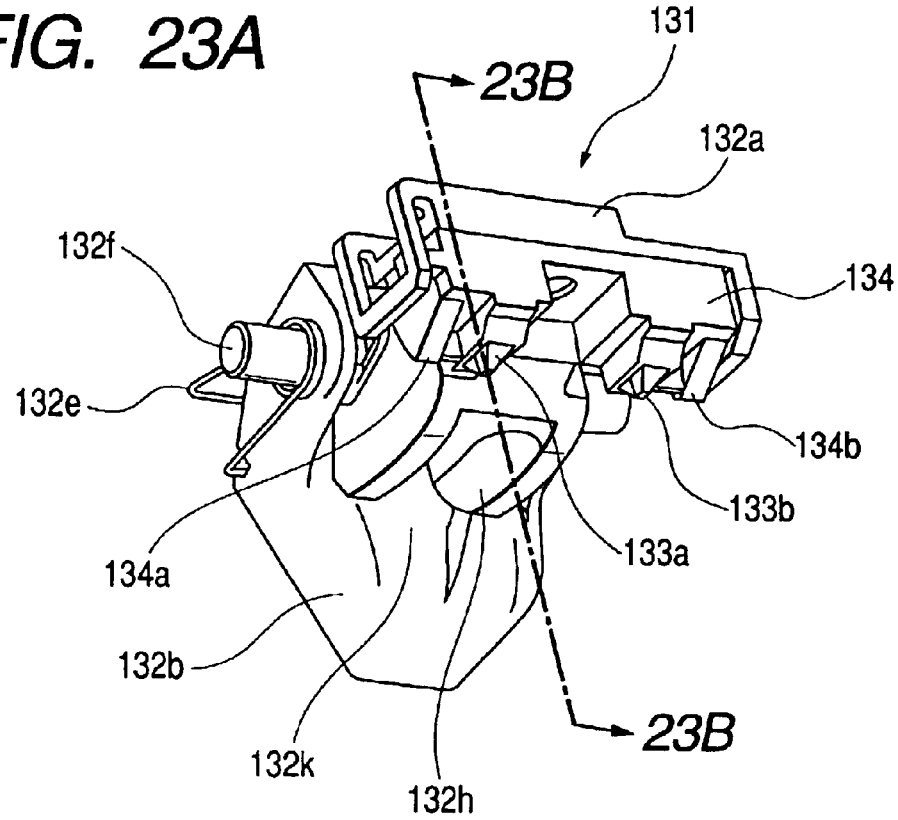
FIG. 23A is a perspective view of the electrical connecting means in the sixth embodiment of the image forming apparatus of the present invention.
Figure 23B:
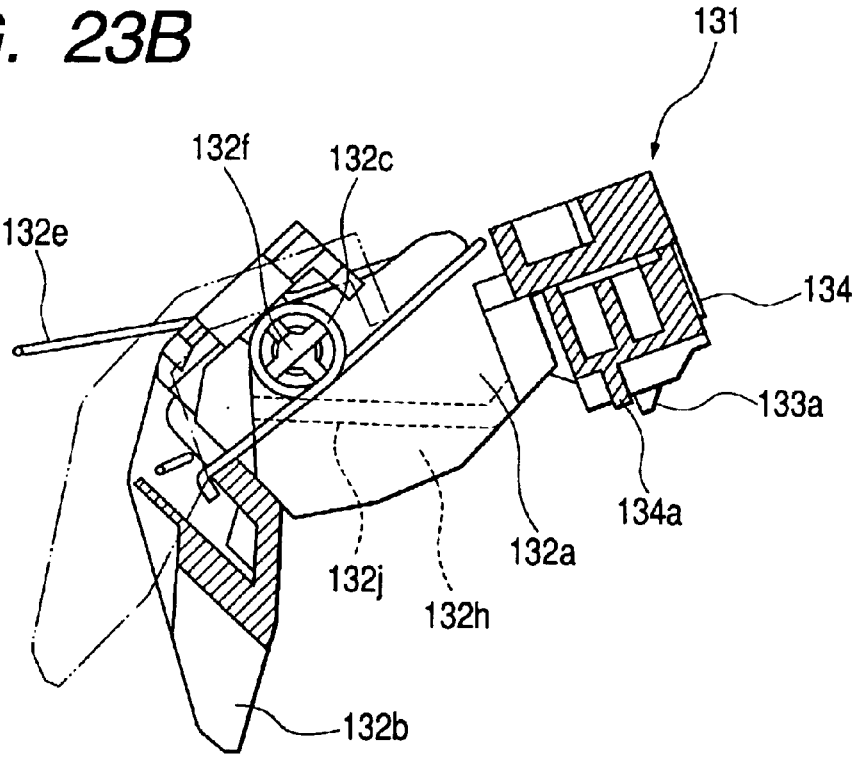
FIG. 23B is a perspective view of the electrical connecting means shown in break lines cut along a dashed line 23B–23B in FIG. 23A.

The electrical connecting means 131 which is the connecting means to support a main body side contact portion in the present embodiment, as shown in FIG. 20, is provided at a position opposed to the storage means 120 of the process cartridge B when the process cartridge B is loaded on the apparatus main body A. This electrical connecting means 131 is provided on a mounting base which is the main body support member arranged at a frame portion 117 for supporting the optical system 101 slidably and movably in a direction (the vertical direction to the paper surface in FIG. 20) orthogonal to the loading direction of the process cartridge. The electrical connecting means 131, as shown in FIGS. 23A and 23B, is constituted by a contact holder 132*a* for holding a connector 134, a holder arm 132*b*, which is a butting receiving portion, against which the butting rib 112*d* provided on the process cartridge butts and a holder spring 132*c* butts. Further, the connector 134 which is the main body contact support portion holds the main body contact portions 133*a*, 133*b* which are the spring members, and on the outside of the main body contact portions 133*a*, 133*b* are formed the abutting ribs or portions 134*a*, 134*b*. The main body contact portions 133*a*, 133*b* are electrically connected with the control substrate 130 of the apparatus main body side mounted on the frame portion 117 via a wire harness (see FIG. 20). Further, in the contact holder 132*a* is provided a slit portion 132*h* as a guide portion for guiding the electrical connecting means 131 in a direction orthogonal to the loading direction of the process cartridge and an upper wall surface portion 132*j* of the slip portion 132*h* as means for controlling movement in a direction vertical to the cartridge inserting direction. When the process cartridge B was loaded on the apparatus main body by this electrical connecting means 131, the main body contact portions 133*a*, 133*b* of the connector 134 abut against the memory element contact portions 121*a*, 121*b* of the storage means 120, and electrically connect the storage means 120 with the control substrate 130, and further abutting portions 134*a*, 134*b* are allowed to butt against the abutting portions 122*a*, 122*b* of the storage means 120.

The holder spring 132*c* of the electrical connecting means 131, as shown in FIG. 23B, which is a view in the direction of the arrow of line 23B-23B in FIG. 23A, abuts against the contact holder 132*a* and the holder arm 132*b*. This holder spring 132*c* biases the contact holder 132*a* clockwise in the drawing with an axis (132*f*) around which the holder spring 132*c* is wound as a center, and biases the holder arm 132*b* in a counterclockwise direction in the drawing. Further, the holder arm 132*b* is constituted so as to be able to rotate to the position shown by a two-dot chain line in the drawing.

The electrical connecting means 131, as described above, is rotatably hung by the mounting base 118 (see FIG. 20 and FIG. 24) arranged at the frame portion 117, which is a partition member. When the process cartridge B is not yet attached, the whole of the electrical connecting means 131 is biased in a counterclockwise direction by a biasing force of the arm spring 132*e* (FIG. 23) arranged at the outside of the holder arm 132*b* with the axis 132*f* as a center in FIG. 24 and FIG. 25. As a result, the main body contact portions 133*a*, 133*b* which are supported by the contact holder 132*a* are shunted and stored more upward than the frame portion 117, and are constituted so as not to interfere with the process cartridge B when the process cartridge B is inserted.

Figure 24:
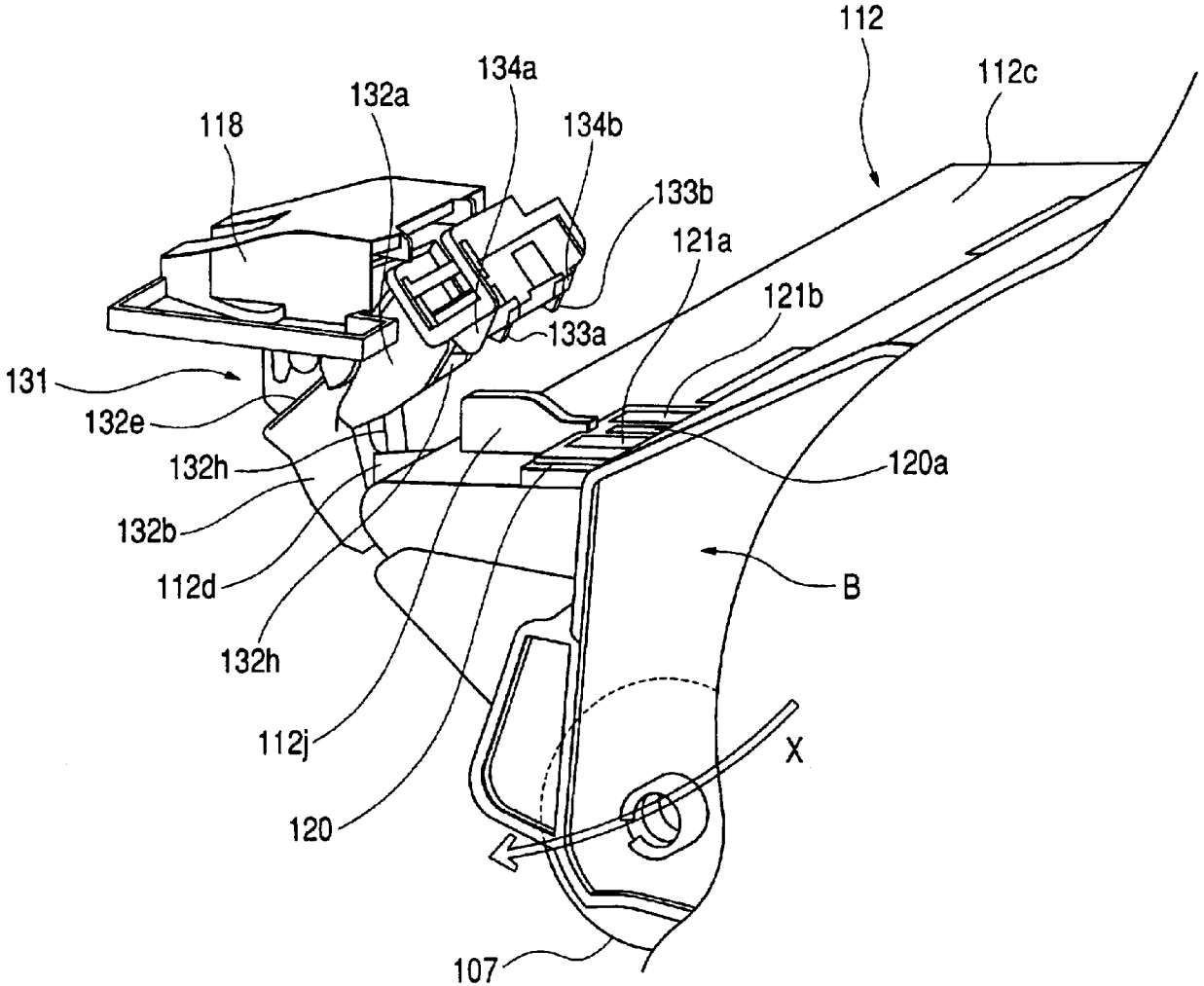
FIG. 24 is a schematic perspective view for. explaining a connecting operation of both contact portions of the electrical connecting means and the storage means in the sixth embodiment of the image forming apparatus of the present invention.
Figure 25:
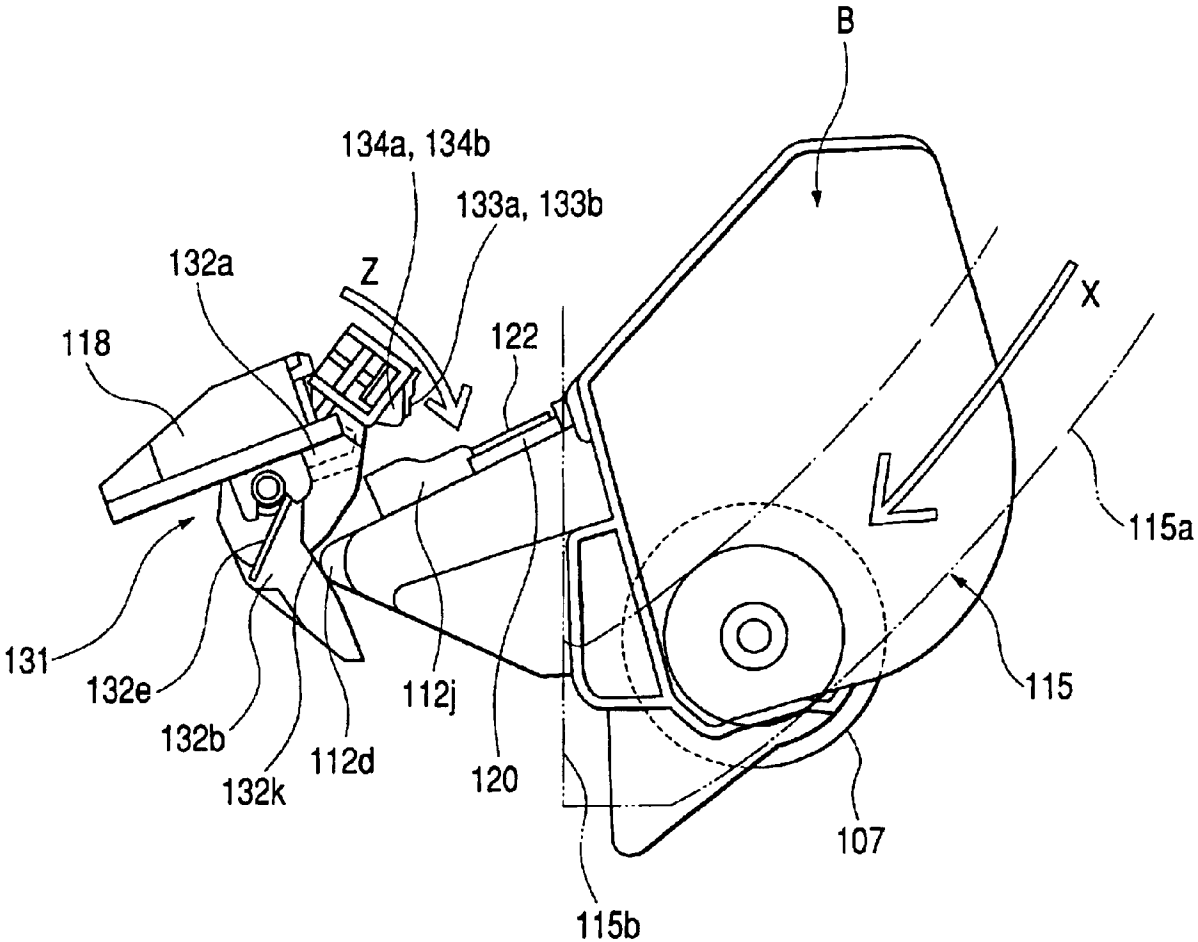
FIG. 25 is a schematic diagram for explaining the connecting operation of both contact portions of the electrical connecting means and the storage means in the sixth embodiment of the image forming apparatus of the present invention.

On the other hand, as described above, in the process cartridge B is provided, as shown in FIGS. 21A and 21B and FIG. 24 to FIG. 26, the guide rib 112*j* for introduction adjacent to the mounting surface 112*e* of the storage means 120 in such a manner as to correspond to the slit portion 132*h* in front of the mounting surface 112*e*. This guide rib 112*j* for introduction is constituted so as to jump into the slip portion 132*h* of the contact holder 132*a* when the process cartridge B is inserted into the apparatus main body. In the upper end surface of this guide rib 112*j*, as shown in FIG. 21 or FIG. 24 and FIG. 25, is formed an upper end surface portion 112*ja* in front of the cartridge inserting direction with its height high. Further, the upper end surface 112*jb* which is a portion following therefrom is formed in such a manner as to become low by gradually inclining to the height of the central positioning rib 112*h*.

At the inserting time of the process cartridge B, as shown in FIG. 24 and FIG. 25, the butting rib 112*d* formed at an end portion in an inserting direction (an arrow mark X direction) of the cartridge frame body 112 butts against a connecting means abutting portion 132*k* of the holder arm 132*b* of the electrical connecting means. Accompanied by further insertion of the process cartridge B, as shown in FIG. 25, the holder arm 132*b* rotates clockwise, and allows the whole electrical connecting means 131 to rotate clockwise (an arrow mark Z direction in the drawing). Note that, in FIG. 25 and FIG. 26, reference numeral 115 denotes a cartridge loading member which is constituted in the apparatus main body A, and reference numeral 115*a* denotes a guide portion, and reference numeral 115*b* a cartridge positioning portion.

By the rotation in a clockwise direction (the arrow mark Z direction in the drawing) of the whole electrical connecting means 131, the guide rib 112*j* of the process cartridge B enters in the slip portion 132*h* of the contact holder 132*a*. In this way, when a position in a direction (a vertical direction to the paper surface in the drawing) orthogonal to the loading direction of the process cartridge B is slightly shifted in the apparatus main body, the guide rib 112*j* of the process cartridge B butts against the side surface of the slip portion 132*h* of the contact holder 132*a*. By pushing the whole electrical connecting means 131 in a direction (thrust direction) orthogonal to the loading direction of the process cartridge B, the electrical connecting means 131 and the storage means 120 of the process cartridge B are mutually moved to an adequate position. Note that this positioning operation in the thrust direction is performed during an inserting operation of the process cartridge B. physical relationship between the guide rib 112*j* and the slip portion 132*h* of the contact holder 132*a* is decided so that the positioning operation is terminated before the main body contact portions 133*a*, 133*b* of the electrical connecting means 131 land on the memory element contact portions 121*a*, 121*b* of the storage means 120. That is, in a state where the upper wall surface portion 132*j* of the slit portion 132*h* abuts against the upper end surface portion of the guide rib 112*j* or the inclined portion 112*jb* following thereof, it is desirable that the positioning operation in the thrust direction is set to be terminated. In this way, after the main body contact portions 133*a*, 133*b* of the contact holder 132*a* of the electrical connecting means 131 have landed on the memory element contact portions 121*a*, 121*b*, the contact portions 133*a*, 133*b* can be prevented from moving in the thrust direction above a storage means contact portion 120*b*.

Figure 26:
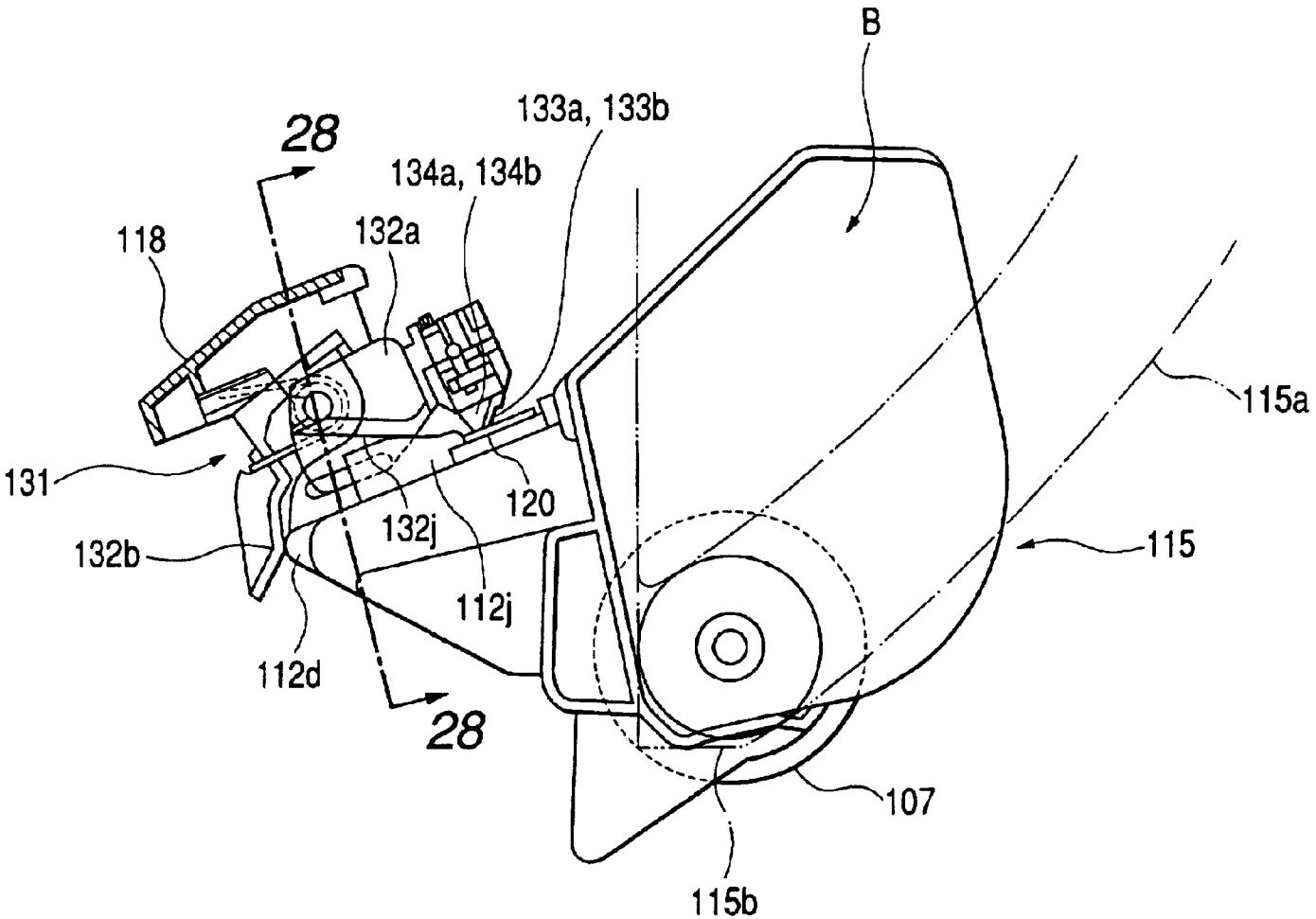
FIG. 26 is a schematic diagram for explaining the connecting operation of both contact portions of the electrical connecting means and the storage means in the sixth embodiment of the image forming apparatus of the present invention.

When the process cartridge B is further inserted into the arrow mark X direction, the electrical connecting means 131 further rotates clockwise, and the upper wall surface portion 132*j* of the slit portion 132*h* moves along the inclined portion 112*jb* of the guide rib 112*j*. The main body contact portions 133*a*, 133*b* of the contact holder 132*a* of the electrical connecting means 131 land on the memory element contact portions 121*a*, 121*b*. Further, abutting ribs 134*a*, 134*b* of the contact holder 132*a* rotate until butting against the abutting portions 122*a*, 122*b* (see FIG. 22) of the storage means 120. When the process cartridge B is further inserted after the abutting ribs 134*a*, 134*b* butt against the abutting portions 122*a*, 122*b* of the storage means 120, only the holder arm 132*b* of the electrical connecting means 131 defies the biasing force of the holder spring 132*c* and rotates clockwise so as to compress the spring 132*c*. The main body contact portions 133*a*, 133*b* move by sliding over the memory element contact portions 121*a*, 121*b* and finally come into a state as shown in FIG. 26. Note that a timing for the main body contact portions 133*a*, 133*b* to touch down onto the memory element contact portions 121*a*, 121*b* may be during the time that the process cartridge is being attached onto the apparatus main body A or after the process cartridge is attached onto the apparatus main body A. In the case of the former, by elastic deformation of the main body contact portions 133*a*, 133*b* including a spring material and movement of the process cartridge, the main body contact portions 133*a*, 133*b* slide over the memory element contact portion 121*b*. In the case of the latter, by elastic deformation of the main body contact portions 133*a*, 133*b*, the main body contact portion 133*a* moves by sliding over the memory element contact portions 121*a*, 121*b*.

In this way, even when there exist component irregularity such as a variation and the like of the position of the butting rib 112*d* of the process cartridge B and the mounting position of the electrical connecting means 131 at production and assembly time, the variation of the posture at the inserting time of the process cartridge B, or the posture change by receiving a driving force after the process cartridge B is loaded on the apparatus main body A, the holder arm 133*b* of the electrical connection means 131 is constituted so as to be able to follow the posture change in the process cartridge B. Hence, the abutting ribs 134*a*, 134*b* of the electrical connecting means 131 can surely butt against the abutting portions 122*a*, 122*b* of the storage means 120.

Further, the abutting ribs 134*a*, 134*b* of the connector 134 are arranged at both sides of the main body contact portions 133*a*, 133*b* so as to be lower than the main body contact portions 133*a*, 133*b*. In this way, the abutting ribs 134*a*, 134*b* butt against the abutting portions 122*a*, 122*b* of the storage means 120, so that strokes of the main body contact portions 133*a*, 133*b* which are spring materials, can be made constant, and the contact pressure (contact pressure) of both contact portions can be stabilized.

Further, the contact holder 132*a* of the electrical connecting means 131, as shown in FIG. 23B, is biased clockwise by the holder spring 132*c*. Hence, the abutting ribs 134*a*, 134*b* of the connector 134 always butt against the memory element contact portions 121*a*, 121*b* of the storage means 120 by the spring pressure of the holder spring 132*c*. Here, the spring pressure of the holder spring 132*c* is set in a condition such that the spring pressure of the holder spring 132*c* is higher than the spring pressure of the main body contact portions 133*a*, 133*b*, so that the abutting ribs 134*a*, 134*b* of the electrical connecting means 131 always butt against the storage means 120.

As described above, at the loading time of the process cartridge B, the holder arm 132*b* of the electrical connecting means 131 is pushed by the butting rib 112*d*, so that the guide rib 112*j* is introduced to the slit portion 132*h* of the contact holder 132*a*. The upper wall surface portion 132*j* fastened by the slit portion 132*h* lands on the upward end surface portion 112*ja* of the guide rib 112*j* or the inclined portion 112*jb* following thereof. That is, by being constituted in this way, the main body contact portions 133*a*, 133*b* of the electrical contact means 131 abut against a region other than the memory element contact portions 121*a*, 121*b* of the storage means 120 so that no deformation nor any damage is received.

The guide rib 112*j* of the process cartridge B has the inclined portion 112*jb*, whose height gradually lowers toward the storage means 120 from the upward end surface portion 112*ja* in front in the cartridge inserting direction. The guide rib 112*j* shall take such a form that the main body contact portions 133*a*, 133*b* of the electrical connecting means 131 and the memory element contact portions 121*a*, 121*b* mutually perform a wiping between a certain distance in the cartridge inserting direction. That is, the upper wall surface portion of the slit portion 132*h* of the contact holder 132*a* moves along the inclined portion of the guide rib 112*j*. In other words, the memory element contact portions 121*a*, 121*b* have a sliding area, on which the main body contact portions 133*a*, 133*b*, which are the main body side contact portions, slide and contact.

Accordingly, by the wiping operation at this sliding time, both contact portions can remove foreign materials, such as the developer, adhered on the mutual contact portions and paper dust and the like of the recording paper, which is the recording medium. Hence, reliability for the electrical connection of both contact portions can be enhanced. Further, in the present embodiment, when the process cartridge B is taken out from the apparatus main body, the main body contact portions 133*a*, 133*b* of the electrical connecting means 131 shunt from a jam process space (a space in which the user puts his hands at the jam process time) of the apparatus interior. For this reason, the contact portions 133*a*, 133*b* are at a position difficult to touch when the operator put his hands into the interior of the apparatus interior.

Further, in the present embodiment, when a positional adjustment is made by following the process cartridge B loaded on the electrical connecting means 131 of the main body apparatus side, the main body contact portions 133*a*, 133*b* of the electrical connecting means 131 reliably abut against the memory element contact portions 121*a*, 121*b* of the storage means 120, and can stabilize the electrical connection.

Further, the accuracy of the position of contact between the main body contact portions 133*a*, 133*b* and the memory element contact portions 121*a*, 121*b* can be enhanced.

Seventh Embodiment

Figure 27:
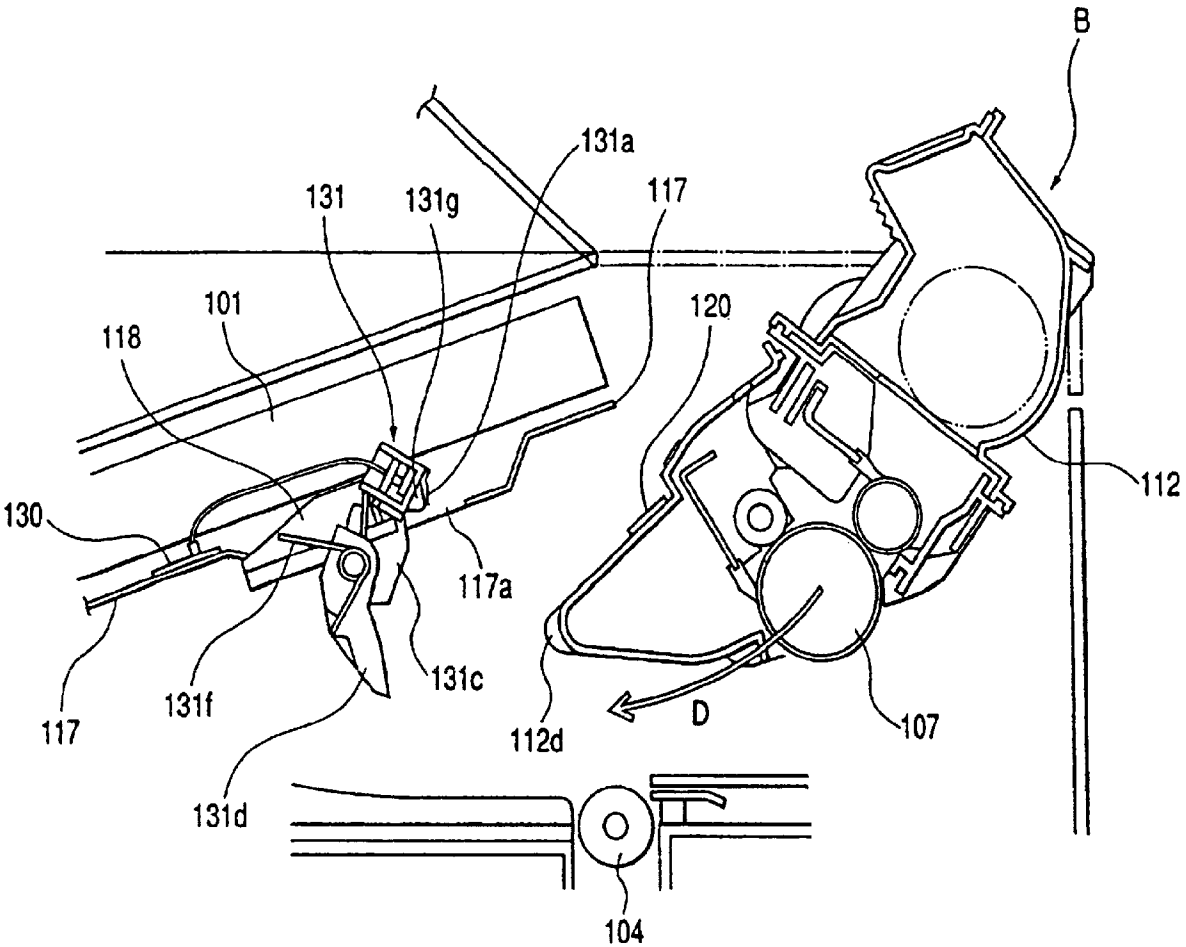
FIG. 27 is a schematic diagram showing a shunting state of connecting means prior to loading the process cartridge on the apparatus main body in a seventh embodiment of the image forming apparatus of the present invention.

Next, a seventh embodiment of the image forming apparatus according to the present invention will be described with reference to FIG. 27. Here, only the points that are different from the sixth embodiment, will be described, and other points will be omitted. Note that the description will be provided by giving the same reference symbols to the same member as those of the sixth embodiment.

Electrical connecting means 131 in the present embodiment, similar to the sixth embodiment, is rotatably hung by a mounting base 118 arranged at an optical system base 117 which fixes a laser scanner 101. In the optical system base 117 is provided an opening 117*a*, which is possible to pass through, when the connecting means 131 rotates. When the process cartridge B is not yet loaded, the connecting means 131 shunts upward to a position which does not interfere with the process cartridge B at its inserting time by an arm spring 131*f* arranged at the outside of a holder arm 131*d*. The connecting means contact portion 131*a* is biased so as to be always stored upward of the optical system base. Accordingly, the connecting means contact portion 131*a* is completely stored upward of the optical system base 117 when the cartridge B is in a state of being not yet loaded.

In this way, when the process cartridge is not yet loaded, the connection means contact portion 131*a* is at the upper portion of the inserting space of the process cartridge, and can completely shunt from this inserting space by a space divided by the optical system base 117 (dividing portion). Hence, operability, e.g., how the apparatus peforms a paper jam process (jam process) and the like, can be improved. Further, the control means and the storage means can be controlled so as not to be influenced by static electricity. Furthermore, by forming the optical system base 117 (dividing member) with a metallic material, the effect thereof can be further increased.

Eighth Embodiment

Next, an eighth embodiment of the image forming apparatus according to the present invention will be described with reference to FIG. 28. In the present embodiment also, only the points that are different from the sixth embodiment, will be described and other points will be omitted. Note that the same reference symbols will be given to the same members as those of the sixth embodiment.

Figure 28:
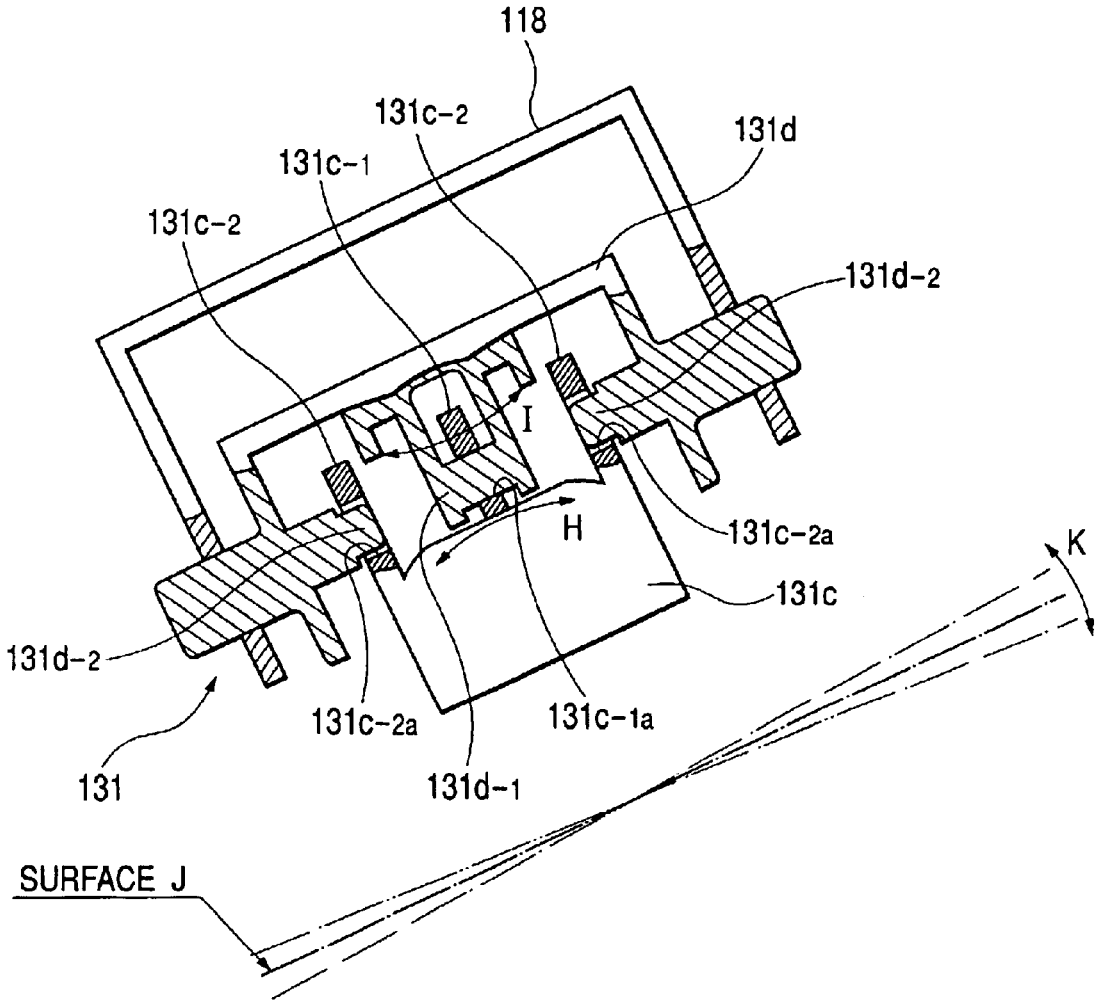
FIG. 28 is a partial cross-sectional view showing a joined relation between the contact holder and a holder arm of connecting means in an eighth embodiment of the image forming apparatus of the present invention.

FIG. 28 is a cross-sectional view cut along the line 28—28 in FIG. 26, and is a cross-sectional view showing a joined portion between a contact holder 131*c* and a holder arm 131*d* in connecting means 131.

The arm holder 131*d* of connecting means 131 is rotatably axially supported by a frame 117, and comprises a central axial portion 131*d*-1, which supports a central rib 131*c*-1 of the contact holder 131*c* and axial portions 131*d*-2, which support the left and right outside ribs 131*c*-2 of the contact holder 131*c*. On the other hand, a mounting hole 131*c*-1*a* formed on the central rib 131*c*-1 of the contact holder 131*c* has a central portion set with a circular arc apex by a fitting dimension, and the left and right outside mounting holes 131*c*-2*a* of a rib 131*c*-2 are set with long holes.

The contact holder 131*c* and the holder arm 131*d* are joined as shown in FIG. 28. That is, in a mounting hole 131*c*-1*a* with a central portion taken as he circular arc apex is inserted the central axial portion 131*d*-1. The outside ribs 131*c*-2 are inserted into long hole mounting holes 131*c*-2*a*. Hence, the contact holder 131*c* is rotatably axially supported by the holder arm 131*d* and, at the same time, is constituted so as to be able to equalize with the holder arm 131*d* like arrow marks H and I in FIG. 28 with the circular arc apex of the central portion of the mounting hole 131*c*-1*a* as a support.

Accordingly, even when the surface (J surface) of the storage means on the process cartridge B inclines as shown by the two-dot chain line shown in FIG. 2B, the contact holder 131*c* can also equalize, and abutting ribs 131*g* at the left and right places on the contact holder 131*c* can stably butt against the surface (J surface) of the storage means 120.

The contact holder 131*c* and the holder arm 131*d* of the connecting means 131 are received at one place of the center, and backlash permitting portions, such as a long hole and the like, are provided on the left and right portions, so that an equalizing function can be given. Even when the storage means 120 on the process cartridge inclines more or less, since the abutting ribs of the left and right two places of connecting means 131 can always stably butt against the storage means 120, the electrical connection between the connecting means 131 and the storage means 120 can be stably performed.

As described above, according to the present invention, when the process cartridge is loaded on the electrophotographic image forming apparatus, the main body electrical contacts provided on the apparatus main body and the cartridge electrical contacts can be stably reliably connected.

Further, when the process cartridge is loaded on the electrophotographic image forming apparatus, the main body electrical contacts provided on the apparatus main body and the cartridge electrical contacts can be stably reliably connected.

What is claimed is:

1. A process cartridge detachably attachable to a main body of an electrophotographic image forming apparatus having movable main body electrical connecting means and a main body electrical contact provided in the main body electrical connecting means, said process cartridge having:

an electrophotographic photosensitive drum;

process means for performing a process on said electrophotographic photosensitive drum;

a frame;

a memory element configured to store information;

a cartridge electrical contact electrically connected with said memory element, said cartridge electrical contact being electrically connected with the main body electrical contact when said process cartridge is attached onto the main body; and a cartridge pushing portion that abuts itself on the main body electrical connecting means and applies pressure to the main body electrical connecting means so as to move the main body electrical connecting means to electrically connect the main body electrical contact to said cartridge electrical contact in the case that said process cartridge is attached to the main body, and to apply pressure to said cartridge electrical contact through the main body electrical contact after the main body electrical contact is electrically connected to said cartridge electrical contact.

2. A process cartridge according to claim 1, wherein said cartridge pushing portion is provided on a top end of said frame when said process cartridge is attached the main body of the electrophotograpic image forming apparatus in an attaching direction in which said process cartridge is attached onto the main body of the electrophotographic image forming apparatus.

3. A process cartridge according to either of claim 1 and claim 2, wherein said cartridge electrical contact is provided on the upper surface side of said frame when said process cartridge is attached onto the main body.

4. A process cartridge according to claim 1, wherein said process cartridge further comprises:

a cartridge guide portion provided on said frame, said cartridge guide portion engaging a main body guide portion provided on the main body electrical connecting means when said process cartridge is being attached onto the main body and performing positioning of the main body electrical connecting means in a direction crossing an attaching direction in which said process cartridge is attached to the main body.

5. A process cartridge detachably attachable to a main body of an image forming apparatus having movable main body electrical connecting means and a main body electrical contact provided in the main body electrical connecting means, said process cartridge comprising:

an electrophotographic photosensitive drum;

a process device configured and positioned to perform a process on said electrophotographic photosensitive drum;

a frame;

a memory element configured to store information;

a cartridge electrical contact electrically connected with said memory element, said cartridge electrical contact being connected with the main body electrical contact when said process cartridge is attached onto the main body;

a cartridge pushing portion that abuts itself on the main body electrical connecting means and applies pressure to the main body electrical connecting means so as to move the main body electrical connecting means to electrically connect the main body electrical contact to said cartridge electrical contact in the case that said process cartridge is attached to the main body, and to apply pressure to said cartridge electrical contact through the main body electrical contact after the main body electrical contact is electrically connected to said cartridge electrical contact; and a cartridge guide portion provided on said frame and configured and positioned to engage a main body guide portion, provided on the main body electrical connecting means, when said process cartridge is being attached onto the main body and to perform a positioning of the main body electrical connecting means in a direction crossing an attaching direction in which said process cartridge is attached onto the main body, said cartridge guide portion protruding on the upper surface side of said frame when said process cartridge is attached onto the main body.

6. An electrophotographic image forming apparatus, for forming an image on a recording medium, detachably attachable to a process cartridge, comprising:

(i) movable main body electrical connecting means;

(ii) a main body electrical contact provided on said main body electrical connecting means;

(iii) attaching means for detachably loading the process cartridge to a main body of said apparatus, the process cartridge having an electrophotographic photosensitive drum, process means acting on the electrophotographic photosensitive drum, a frame, a memory element configured to store information, a cartridge electrical contact electrically connected with the memory element, the cartridge electrical contact being electrically connected with said main body electrical contact when the process cartridge is being attached onto said electrophotographic image forming apparatus, and a cartridge pushing portion that abuts itself on said main body electrical connecting means and applies pressure to said main body electrical connecting means so as to move said main body electrical connecting means to electrically connect said main body electrical contact to the cartridge electrical contact in the case that the process cartridge is attached to the main body of said apparatus, and to apply pressure to the cartridge electrical contact through said main body electrical contact after said main body electrical contact is electrically connected to the cartridge electrical contact; and (iv) conveying means for conveying the recording medium.

7. An electrophotographic image forming apparatus according to claim 6, wherein said main body electrical contact is separable from the cartridge electrical contact in a separation direction, and wherein said main body electrical connecting means comprises:

a movable member movably provided for the main body and supporting said main body electrical contact; and a spring member provided between said movable member and the main body, said spring member biasing said movable member in the separation direction in which said main body electrical contact separates from the cartridge electrical contact.

8. An electrophotographic image forming apparatus according to claim 6, wherein said main body electrical contact is separable from the cartridge electrical contact in a separation direction, and wherein said main body electrical connecting means comprises:

a first movable member movably provided for the main body;

a first spring member provided between said first movable member and the main body, said first spring member biasing said first movable member in the separation direction in which said main body electrical contact separates from the cartridge electrical contact;

a second movable member movably provided for said first movable member and supporting said main body electrical contact; and a second spring member provided between said first movable member and said second movable member, said second spring member biasing said second movable member in a direction where said main body electrical contact is electrically connected with the cartridge electrical contact.

9. An electrophotographic image forming apparatus according to claim 6, wherein said main body electrical connecting means comprises a main body guide portion engaged with a cartridge guide portion, provided on the process cartridge, when the process cartridge is being attached onto the main body, said main body guide portion positioning said main body electrical connecting means in a direction crossing a loading direction in which the process cartridge is attached onto the main body.

10. An electrophotographic image forming apparatus for forming an image on a recording medium and being detachably attachable to a process cartridge having a memory element configured to store information and a cartridge electrical contact electrically connected with the memory element, said apparatus comprising:

(i) main body electrical connecting means comprising a main body electrical contact configured and positioned to electrically connect with the cartridge electrical contact when the process cartridge is attached onto a main body of said electrophotographic image forming apparatus and to be separated from the cartridge electrical contact;

(ii) a first movable member rotatably provided for said main body;

(iii) a first spring member provided between said first movable member and said main body, said first spring member biasing said first movable member in a direction in which said main body electrical contact separates from the cartridge electrical contact;

(iv) a second movable member rotatably provided for said first movable member and supporting said main body electrical contact;

(v) a second spring member provided between said first movable member and said second movable member, said second spring member biasing said second movable member in a direction in which said main body electrical contact is electrically connected with the cartridge electrical contact;

(vi) attaching means for removably detachably loading the process cartridge to said main body of said apparatus, the process cartridge having an electrophotographic photosensitive drum, process means for performing a process on the electrophotographic photosensitive drum, a frame, the memory element configured to store information, the cartridge electrical contact electrically connected with the memory element and electrically connecting with said main body electrical contact when the process cartridge is attached onto said main body of said electrophotographic image forming apparatus, the cartridge electrical contact, and a cartridge pushing portion that abuts itself on said main body electrical connecting means and applies pressure to said main body electrical connecting means so as to move said main body electrical connecting means to electrically connect said main body electrical contact to the cartridge electrical contact in the case that the process cartridge is attached to said main body, and applies pressure to the cartridge electrical contact through said main body electrical contact after said main body electrical contact is electrically connected to the cartridge electrical contact; and (vii) conveying means for conveying the recording medium.

11. A process cartridge detachably attachable to a main body of an electrophotographic image forming apparatus having movable main body electrical connecting means, a main body electrical contact provided on the main body electrical contacting means, and a main body guide portion provided on the main body electrical connecting means, said process cartridge comprising:

an electrophotographic photosensitive drum;

process means for performing a process on said electrophotographic photosensitive body drum;

a frame;

a memory element configured to store information;

a cartridge electrical contact electrically connected with said memory element, said cartridge electrical contact being electrically connected with the main body electrical contact when said process cartridge is attached onto the main body of the apparatus;

a cartridge guide portion protruding from said frame and engaging with the main body guide portion when said process cartridge is being attached onto the main body and performing positioning of said main body electrical connecting means in a direction to crossing a loading direction in which said process cartridge is attached to the main body of the apparatus and abutting against the main body electrical connecting means so that the main body electrical contact is guided to said cartridge electrical contact in a direction in which the main body electrical contact is electrically connected with said cartridge electrical contact; and a cartridge pushing portion that abuts itself on the main body electrical connecting means and applies pressure to the main body electrical connecting means so as to move the main body electrical connecting means to electrically connect the main body electrical contact to said cartridge electrical contact in the case that said process cartridge is attached to the main body, to cause the main body electrical connecting means to be guided along said cartridge guide portion in the case that said cartridge guide portion is abutted onto the main body electrical connecting means and to apply a pressure to said cartridge electrical contact through the main body electrical contact after the main body electrical contact is electrically connected to said cartridge electrical contact.

12. A process cartridge according to claim 11, wherein said cartridge guide portion is a protrusion protruding from said frame, and a side surface of said protrusion engages with the main body guide portion and performs a positioning of the main body electrical connecting means in a direction crossing the loading direction of said process cartridge, and the upper surface of said protrusion abuts against the main body electrical connecting means so as to guide the main body electrical contact to said cartridge electrical contact.

13. An electrophotographic image forming apparatus detachably attachable to a process cartridge and forming an image on a recording medium, comprising:

(i) movable main body electrical connecting means;

(ii) a main body electrical contact provided on said main body electrical connecting means;

(iii) a main body guide portion provided on said main body electrical connecting means;

(iv) attaching means removably attachable to the process cartridge having an electrophotographic photosensitive drum, process means for performing a process on the electrophotographic photosensitive drum, a frame, a memory element configured to store information, a cartridge electrical contact electrically connected with the memory element, the cartridge electrical contact being electrically connected with said main body electrical contact when the process cartridge is attached onto a main body of said apparatus, a cartridge guide portion protruding from the frame, the cartridge guide portion engaging with said main body guide portion when the process cartridge is being attached onto said main body of said electrophotographic image forming apparatus and performing positioning of said main body electrical connecting means in a direction crossing an attaching direction in which the process cartridge is attached to said attaching means and abutting against said main body electrical connecting means so that said main body electrical contact is guided to the cartridge electrical contact in a direction in which said main body electrical contact is electrically connected with the cartridge electrical contact, and a cartridge pushing portion that abuts itself on said main body electrical connecting means and applies pressure to said main body electrical connecting means so as to move said main body electrical connecting means to electrically connect said main body electrical contact to the cartridge electrical contact in the case that the process cartridge is attached to said main body, to cause said main body electrical connecting means to be guided along the cartridge guide portion in the case that the cartridge guide portion is abutted onto said main body electrical connecting means and to apply pressure to the cartridge electrical contact through said main body electrical contact after said main body electrical contact is electrically connected to the cartridge electrical contact; and (v) conveying means for conveying said recording medium.

14. An electrophotographic image forming apparatus according to claim 13, wherein said main body guide portion is in the shape of a groove, and a bottom of said groove abuts against the cartridge guide portion for guiding said main body electrical contact to the cartridge electrical contact.

15. An electrophotographic image forming apparatus according to claim 13, wherein said main body electrical contact is oscillationally supported against said main body electrical connecting means.

16. An electrophotographic image forming apparatus according to claim 7, wherein said movable member is provided with a connecting means abutting portion to which the cartridge pressure portion abuts.

17. A process cartridge according to any one of claims 1, 5 and 11, wherein said process cartridge integrally unifies at least one of charging means as said process means, developing means and cleaning means into a cartridge with said electrophotographic photosensitive drum and makes it detachably attachable to the main body.

18. A process cartridge according to any one of claims 1, 5, and 11, wherein, in the case that said process cartridge is attached to the main body, the main body electrical contact is electrically connected to said cartridge electrical contact upstream of the position of said cartridge pushing portion along the direction in which said process cartridge is attached to the main body.

19. A process cartridge according to any one of claims 1, 5, and 11, wherein the main body electrical contacting means is rotatable with respect to the main body, and wherein said cartridge pushing portion rotates the main body electrical connecting means to connect the main body electrical contact with said cartridge electrical contact in the case that said process cartridge is being attached to the main body.

20. An electrophotographic image forming apparatus according to any one of claims 6, 10 and 13, wherein, in the case that the process cartridge is attached to said main body, said main body electrical contact is electrically connected to the cartridge electrical contact upstream of the position of the cartridge pushing portion along the direction in which the process cartridge is attached to said main body.

21. An electrophotographic image forming apparatus according to any one of claims 6, 10 and 13, wherein said main body electrical connecting means is rotatable with respect to said main body, and wherein the cartridge pushing portion rotates said main body electrical connecting means to connect said main body electrical contact with the cartridge electrical contact in the case that the process cartridge is being attached to said main body.

22. A process cartridge detachably attachable to a main body of an electrophotographic image forming apparatus having a movable main body electrical connecting means and a main body electrical contact provided in the main body electrical connecting means, said process cartridge comprising:

an electrophotgraphic photosensitive drum;

process means for performing a process on said electrophotographic photosensitive drum;

a memory element configured to store information;

a cartridge electrical contact electrically connected with said memory element, said cartridge electrical contact being electrically connected with the main body electrical contact when said process cartridge is attached onto the main body; and a portion that abuts itself on the main body electrical connecting means and applies pressure to the main body electrical connecting means so as to apply pressure to said cartridge electrical contact through the main body electrical contact after the main body electrical contact is electrically connected to said cartridge electrical contact.

23. An electrophotographic image forming apparatus, for forming an image on a recording medium, detachably attachable to a process cartridge, comprising:

(i) movable main body electrical connecting means;

(ii) a main body electrical contact on said main body electrical connecting means;

(iii) attaching means for detachably loading the process cartridge to a main body of said apparatus, the process cartridge having an electrophotographic photosensitive drum, process means for performing a process on the electrophotographic photosensitive drum, a memory element configured to store information, a cartridge electrical contact electrically connected with the memory element, the cartridge electrical contact being electrically connected with said main body electrical contact when the process cartridge is attached onto said electrophotographic image forming apparatus, and a portion that abuts itself on said main body electrical connecting means and applies pressure to said main body electrical connecting means so as to apply pressure to the cartridge electrical contact through said main body electrical contact after said main body electrical contact is electrically connected to the cartridge electrical contact; and (iv) conveying means for conveying the recording medium.

* * * * *

UNITED STATES PATENT AND TRADEMARK OFFICE

CERTIFICATE OF CORRECTION

PATENT NO. : 6,922,534 B2
DATED : July 26, 2005
INVENTOR(S) : Hiroshi Goto et al.

It is certified that error appears in the above-identified patent and that said Letters Patent is hereby corrected as shown below:

Title page,
Item [75], Inventors, "Yoshihisa Ibaraki, Shizuoka (JP);" should read -- Yoshihisa Ibaraki, Kyoto (JP); --.
Item [30], Foreign Application Priority Data, "2000/399266" should read -- 2001/399266 --; and "2002/195355" should read -- 2002/195388 --.
Item [56], References Cited, U.S. PATENT DOCUMENTS,
"Karamama et al." should read -- Karakama et al. --.
"2002/0034357 A1" should read -- 2002/0031357 Al --.

Column 1,
Line 15, "includes, for example," should read -- include, --.

Column 2,
Line 6, "in the" should read -- in --.

Column 6,
Line 38, "portion" should read -- portion, --.
Line 56, "a" should read -- an --.

Column 7,
Line 1, "force;" should read -- force, --.

Column 8,
Line 4, "for." should read -- for --.
Line 64, "therein ," should read -- therein, --.

Column 9,
Line 13, "cartridge" should read -- cartridge B --.

Column 10,
Line 1, "only)" should read -- only). --.

Column 11,
Line 25, "above described" should read -- above-described --.
Line 47, "and" should read -- and the --.
Line 50, "conditions-and" should read -- conditions and --.

Column 12,
Line 30, "sliderably" should read -- slidably --.

UNITED STATES PATENT AND TRADEMARK OFFICE

CERTIFICATE OF CORRECTION

PATENT NO. : 6,922,534 B2
DATED : July 26, 2005
INVENTOR(S) : Hiroshi Goto et al.

It is certified that error appears in the above-identified patent and that said Letters Patent is hereby corrected as shown below:

Column 17,
Line 34, “shutting” should read -- shunting --.

Column 18,
Line 56, “the” should read -- the points --.

Column 21,
Line 25, “to” should be deleted.

Column 22,
Line 30, “above described” should read -- above-described --.
Line 52, “an” should read -- a --.

Column 24,
Line 20, “operator of” should read -- operator --.

Column 25,
Line 12, “contacts” should read -- contacts, --.
Line 34, “calking” should read -- caulking --.

Column 27,
Line 40, “physical” should read -- The physical --.

Column 28,
Line 40, “(contact pressure)” should be deleted.

Column 30,
Line 4, “peforms” should read -- performs --.
Line 36, “he” should read -- the --.
Line 37, “inserted” should read -- inserted in --.
Line 47, “FIG. 2B,” should read -- FIG. 28, --.

Column 31,
Line 11, “having:” should read -- comprising: --.
Line 35, “attached” should read -- attached to --.

Column 33,
Line 19, “where” should read -- in which --.

UNITED STATES PATENT AND TRADEMARK OFFICE

CERTIFICATE OF CORRECTION

PATENT NO. : 6,922,534 B2
DATED : July 26, 2005
INVENTOR(S) : Hiroshi Goto et al.

It is certified that error appears in the above-identified patent and that said Letters Patent is hereby corrected as shown below:

Column 34,
Line 24, “contacting” should read -- connecting --.
Line 40, “said” should read -- the --.
Line 41, “to” should be deleted.

Column 36,
Line 15, “contacting” should read -- connecting --.

Signed and Sealed this

Thirty-first Day of January, 2006

JON W. DUDAS
*Director of the United States Patent and Trademark Office*